US007600961B2

(12) United States Patent
Abdallah

(10) Patent No.: US 7,600,961 B2
(45) Date of Patent: Oct. 13, 2009

(54) FLUID TRANSFER CONTROLLERS HAVING A ROTOR ASSEMBLY WITH MULTIPLE SETS OF ROTOR BLADES ARRANGED IN PROXIMITY AND ABOUT THE SAME HUB COMPONENT AND FURTHER HAVING BARRIER COMPONENTS CONFIGURED TO FORM PASSAGES FOR ROUTING FLUID THROUGH THE MULTIPLE SETS OF ROTOR BLADES

(75) Inventor: Shaaban A. Abdallah, Cincinnati, OH (US)

(73) Assignee: Macro-Micro Devices, Inc., Dallas, TX (US)

( * ) Notice: Subject to any disclaimer, the term of this patent is extended or adjusted under 35 U.S.C. 154(b) by 505 days.

(21) Appl. No.: 11/322,100

(22) Filed: Dec. 29, 2005

(65) Prior Publication Data

US 2007/0154304 A1 Jul. 5, 2007

(51) Int. Cl.
*F01D 3/02* (2006.01)

(52) U.S. Cl. ..... 415/1; 415/56.5; 415/57.1; 415/57.2; 415/58.4; 415/100; 415/126; 415/199.1

(58) Field of Classification Search ..... 415/56.5, 415/57.1, 57.2, 58.4, 58.6, 100, 123, 126, 415/144, 199.1, 200, 1
See application file for complete search history.

(56) References Cited

U.S. PATENT DOCUMENTS 671,090 A * 4/1901 Morton ..... 415/100
713,261 A * 11/1902 Whitaker ..... 415/65
743,296 A * 11/1903 Kugel et al. ..... 415/100
1,050,410 A * 1/1913 Wainwright ..... 60/698

(Continued)

FOREIGN PATENT DOCUMENTS

DE 2115330 10/1972

(Continued)

OTHER PUBLICATIONS

International Search Report, PCT/US2006/061838, mailed Oct. 26, 2007.

*Primary Examiner*—Edward Look
*Assistant Examiner*—Aaron R Eastman
(74) *Attorney, Agent, or Firm*—Kevin L. Daffer; Mollie E. Lettang; Daffer McDaniel, LLP

(57) ABSTRACT

Fluid transfer controllers (FTCs) having a rotor assembly with multiple rotor blade sets coupled to a hub component of the rotor assembly and further having barrier components forming passages for routing fluid through the multiple rotor blade sets are provided. More specifically, the FTCs include passages for routing fluid along one side of a dividing structure to which a first set of rotor blades is attached and subsequently along the opposite side of the dividing structure to which a second set of rotor blades is attached. The dividing structure may be the hub component of the rotor assembly or a partition separating different levels of rotor blades within the rotor assembly. In some cases, the FTCs may be configured to route fluid from the first rotor blade set to a thermal energy alteration device and further route fluid from the thermal energy alteration device to the second rotor blade set.

43 Claims, 8 Drawing Sheets

U.S. PATENT DOCUMENTS

| | | | | | |
|---|---|---|---|---|---|
| 1,081,725 | A | * | 12/1913 | Dodge | 415/99 |
| 1,161,116 | A | * | 11/1915 | Ehrhart | 188/296 |
| 1,820,344 | A | * | 8/1931 | Caldwell | 415/199.1 |
| 1,941,442 | A | * | 12/1933 | Moran et al. | 415/100 |
| 2,655,364 | A | * | 10/1953 | Maldague | 432/220 |
| 2,928,261 | A | * | 3/1960 | Sampietro | 62/402 |
| 3,143,103 | A | * | 8/1964 | Zuhn | 60/599 |
| 3,303,993 | A | * | 2/1967 | Andrews et al. | 417/355 |
| 3,384,022 | A | * | 5/1968 | Masao | 415/143 |
| 3,523,428 | A | * | 8/1970 | Nagyszalanczy | 62/402 |
| 3,956,904 | A | | 5/1976 | Edwards | |
| 6,062,028 | A | * | 5/2000 | Arnold et al. | 60/612 |
| 6,430,917 | B1 | * | 8/2002 | Platts | 60/39.43 |
| 6,589,013 | B2 | | 7/2003 | Abdallah | |

FOREIGN PATENT DOCUMENTS

| | | | |
|---|---|---|---|
| JP | 3115795 | | 5/1991 |
| JP | 03115795 | A * | 5/1991 |

* cited by examiner

FLUID TRANSFER CONTROLLERS HAVING A ROTOR ASSEMBLY WITH MULTIPLE SETS OF ROTOR BLADES ARRANGED IN PROXIMITY AND ABOUT THE SAME HUB COMPONENT AND FURTHER HAVING BARRIER COMPONENTS CONFIGURED TO FORM PASSAGES FOR ROUTING FLUID THROUGH THE MULTIPLE SETS OF ROTOR BLADES

BACKGROUND OF THE INVENTION

1. Field of the Invention

The present invention relates to fluid flow equipment, and more particularly, to fluid transfer controlling equipment such as compressors, pumps, blowers, and power generation devices (e.g., turbochargers and turbo-engines).

2. Description of the Related Art

The following descriptions and examples are not admitted to be prior art by virtue of their inclusion within this section.

Fluid transfer controllers are used for a variety of functions, including but not necessarily limited to compressing and pumping fluids as well as converting energy from flowing fluids for power generation devices. Exemplary applications for fluid transfer controllers with one or more of such functions include aircraft jet engines, industrial gas compressors, pipeline transports, refrigeration systems, as well as several others. In general, fluid transfer controlling equipment (referred to hereinafter as "fluid transfer controllers" and "fluid flow controllers" interchangeably) may refer to apparatuses that direct, manage, and/or influence the course of liquids, gases, liquid-gas combinations, and/or combinations of solids with liquids and/or gases. Some fluid transfer controllers have components which are similar in design. For instance, a common component within some fluid transfer controllers is a centrifugal rotor. A centrifugal rotor generally includes blades extending radially outward from a central component, the gaps between the blades defining the fluid flow path through the rotor. During operation, fluid typically enters the centrifugal rotor near the central component in a direction substantially parallel to its rotational axis, moves through the gaps between the blades by centrifugal force, and exits the rotor in a direction substantially perpendicular to the rotational axis of the rotor. The fluid is then generally directed into a collector (e.g., a volute) and subsequently through an outlet of the fluid transfer controller.

By appropriately rotating the rotor, the blades of the rotor may accelerate the fluid, allowing the fluid to exit the rotor assembly with increased velocity and possibly increased pressure. As such, the degree of fluid flow acceleration in a centrifugal rotor assembly is largely affected by the size and speed of rotation of the rotor as well as the orientation of the blades on the rotor. Unfortunately, however, the extent to which the orientation, size, and speed of the rotor blades may be effectively manipulated to enhance fluid flow acceleration is limited. In an attempt to circumvent this problem, many fluid transfer system designers arrange a plurality of fluid transfer controllers in series to obtain greater fluid velocity and/or pressure rises than those that may be obtained from a single fluid transfer controller using the same type of rotor (i.e., a rotor of the same size and having similar blade configuration). In particular, designers often integrate conduits between outlets and inlets of distinct fluid transfer controllers such that fluid may be successively routed through each without interruption.

Fluid transfer systems employing serially arranged fluid transfer controllers to increase fluid flow velocity and/or pressure, however, are not without their own shortcomings. In particular, transporting a fluid between controllers without significantly diminishing its velocity or pressure is difficult and, thus, the efficiency of fluid transfer controllers arranged in series is often less than a single fluid transfer controller with the same type of rotor. In addition, fluid transfer controllers arranged in series are substantially larger than a single fluid transfer controller with the same type of rotor, increasing the size of the fluid transfer system. In some applications, small fluid transfer systems are needed due to space constraints and, thus, employing a fluid transfer system with serially arranged fluid transfer controllers may not be an option in some cases. Furthermore, the noise generated from fluid transfer systems having serially arranged fluid transfer controllers is compounded relative to the number of fluid transfer controllers employed. Limiting noise generation, however, is beneficial in many applications, particularly when used in areas of human occupancy.

Moreover, initial fabrication costs as well as the cost and time required to maintain fluid transfer controllers arranged in series are typically proportional to the number of fluid transfer controllers employed. In some cases, costs and maintenance downtime are further increased when a rotational shaft is shared among fluid transfer controllers in series. In particular, a shaft providing rotational motion for rotors of multiple fluid transfer controllers in series needs to be substantially longer than those used for single fluid transfer controller systems. Longer shafts typically require more precise dimensions and are generally more difficult to maintain than shorter shafts. As a consequence, the inclusion of a long shaft may substantially increase costs and maintenance downtime for systems having fluid transfer controllers arranged in series.

Accordingly, it would be desirable to develop a compact fluid transfer controller that increases the range of fluid flow acceleration as compared to conventional designs. It would be further advantageous for such a fluid transfer controller to limit the level of noise generated therefrom.

SUMMARY OF THE INVENTION

The problems outlined above may be in large part addressed by fluid transfer controlling equipment having a rotor assembly with multiple sets of rotor blades coupled to a common hub component and barrier components configured to form passages for routing fluid through the multiple sets of rotor blades. The following are mere exemplary embodiments of fluid transfer controllers, systems which include one or more fluid transfer controllers, a rotor assembly, and a method for transporting fluid through a fluid transfer controller. The following are not to be construed in any way to limit the subject matter of the claims.

One embodiment of a rotor assembly includes a hub component, a first set of rotor blades coupled to the hub component, a first partition coupled to edges of the first set of rotor blades opposing the hub component, and a second set of rotor blades coupled to a side of the first partition opposing the first set of rotor blades.

One embodiment of a fluid transfer controller includes a rotor assembly having a hub component and multiple levels of rotor blades coupled by one or more intervening partitions, wherein the multiple levels of rotor blades and one or more intervening partitions are serially stacked upon the hub component. The fluid transfer controller further includes barrier components configured to form passages for routing fluid among different levels of rotor blades of the multiple levels of rotor blades.

Another embodiment of a fluid transfer controller includes a rotor assembly comprising multiple sets of rotor blades coupled to a common hub component and barrier components configured to form passages between the multiple sets of rotor blades. The barrier components are configured such that the multiple sets of rotor blades and the passages collectively form a spiraled fluid flow route about an annular reference spaced about a rotational axis of the common hub component.

Yet another embodiment of a fluid transfer controller includes a rotor assembly with a first set of rotor blades and a second set of rotor blades respectively coupled to opposite sides of a dividing structure. The fluid transfer controller further includes barrier components configured to form a passage for fluid to flow along the side of the dividing structure comprising the first set of rotor blades and subsequently along the opposite side of the dividing structure comprising the second set of rotor blades.

An embodiment of a turbo-engine includes a rotor assembly with a hub component coupled to a rotary shaft and multiple sets of rotor blades connected to at least one side of the hub component. At least a first set of rotor blades of the multiple sets of rotor blades is configured to compress fluid and at least a second set of rotor blades of the multiple sets of rotor blades is configured to convert thermal energy of a fluid into mechanical energy. The turbo-engine further includes a thermal energy alteration device configured to alter the thermal energy of a fluid and a first passage configured to route fluid from at least the first set of rotor blades to the thermal energy alteration device. In addition, the turbo-engine includes a second passage configured route fluid from the thermal energy alteration device to at least the second set of rotor blades.

An embodiment of a method for transporting fluid through a fluid transfer controller includes drawing fluid axially into a fluid inlet of the fluid transfer controller and moving the drawn fluid radially through a first set of rotor blades of a rotor assembly of the fluid transfer controller. In addition, the method includes routing the fluid along a first set of passages winding along the rotor assembly and connecting the first set of rotor blades to a second set of rotor blades of the rotor assembly. Moreover, the method includes moving the fluid radially through the second set of blades and dispensing the fluid through an outlet of the fluid transfer controller subsequent to moving the fluid radially through the second set of blades.

BRIEF DESCRIPTION OF THE DRAWINGS

Other objects and advantages of the invention will become apparent upon reading the following detailed description and upon reference to the accompanying drawings in which.

Figure 3:
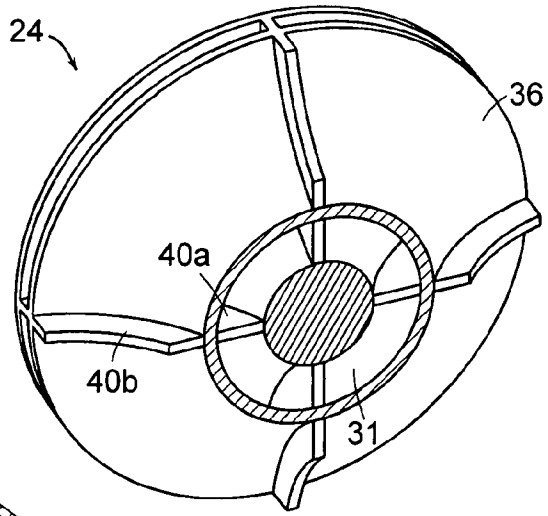
FIG. 3 depicts a perspective view of an exemplary rotor assembly included within the fluid transfer controller illustrated in FIG. 1.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE INVENTION

Turning to the drawings, exemplary configurations of fluid transfer controllers having rotor assemblies with multiple sets of rotor blades coupled to a common hub component are provided in FIGS. 1-14. In particular, fluid transfer controllers having rotor assemblies with multiple levels of rotor blades separated by partitions and successively stacked upon a common hub component are illustrated in FIGS. 1, 2, 4, 5, 7*a*, 7*b*, 8, 10, 11, 13, and 14. In addition, fluid transfer controllers having rotor assemblies with rotor blades coupled to opposing sides of a common hub component are illustrated in FIGS. 6*a*-8, and 12-14. FIG. 9 depicts a system having a plurality of fluid transfer controllers arranged in series at least one of which includes a configuration described in reference to FIGS. 1-8 and, as such, depicts at least one fluid transfer controller with multiple sets of rotor blades coupled to a common hub component. FIG. 3 depicts a perspective view of the rotor assembly depicted in FIG. 1. A more detailed description of the arrangement and configuration of rotor blades within the fluid transfer controllers depicted in FIGS. 1-14 is provided below in reference to the specific figures.

As will be further described in more detail below, the fluid transfer controllers described herein include barrier components configured to form passages for routing fluid through the multiple sets of rotor blades in a compact manner. More specifically, the fluid transfer controllers include barrier components configured to form passages that allow fluid to be routed along one side of a dividing structure to which a first set of rotor blades are attached and subsequently along the opposite side of the dividing structure to which a second set of rotor blades are attached. In some cases, the dividing structure may be the hub component of the rotor assembly. In other cases, however, the dividing structure may be a partition separating different levels of rotor blades within the rotor assembly. In either case, the multiple sets of rotor blades and connecting passages may, in some embodiments, be collectively configured to form a spiral fluid flow route about an annular reference spaced about a rotational axis of the hub component of the rotor assembly. Exemplary configurations of fluid transfer controllers inducing a spiral fluid flow route are illustrated in FIGS. 1, 4, 6*a*-8, 11, 13, and 14 and are described in more detail below. In other cases, the fluid transfer controllers described herein may be additionally or alternatively configured to induce a fluid flow route in a non-spiral pattern, such as illustrated and described in reference to FIGS. 5, 10, and 12, for example. As with the description of the rotor blade configurations, a more detailed description of the arrangement and configuration of the barrier components within the fluid transfer controllers depicted in FIGS. 1-14 is provided below in reference to the specific figures.

In addition to their differing rotor blade and barrier component configurations, further distinctions between the fluid transfer controllers and systems described in reference to FIGS. 1-14 are their intended functions. In particular, the configurations of fluid transfer controllers depicted in FIGS. 1-9 produce an increase of fluid velocity and/or pressure and, thus, may serve as a compressor, pump, blower, or turbocharger. In contrast, the fluid transfer controllers described in reference to FIGS. 10-14 may generally be configured to function as turbo-engines having a compressor and a turbine each characterized by one or more sets of rotor blades and configured for coupling to a thermal energy alteration device. As used herein, compressors may generally refer to fluid transfer controllers that are configured to increase the pressure of fluids. Pumps may generally refer to fluid transfer controllers configured to transfer fluids, often by pressure and/or suction. Moreover, blowers may refer to fluid transfer controllers configured to generate a current of air or a gas. While not exclusive to being categorized as a compressor, a pump, and/or a blower, turbochargers may refer to a more specific class of fluid transfer controllers. In particular, turbochargers may refer to fluid transfer controllers having centrifugal blowers driven by exhaust gas turbines and used to supercharge an engine.

Figure 2:
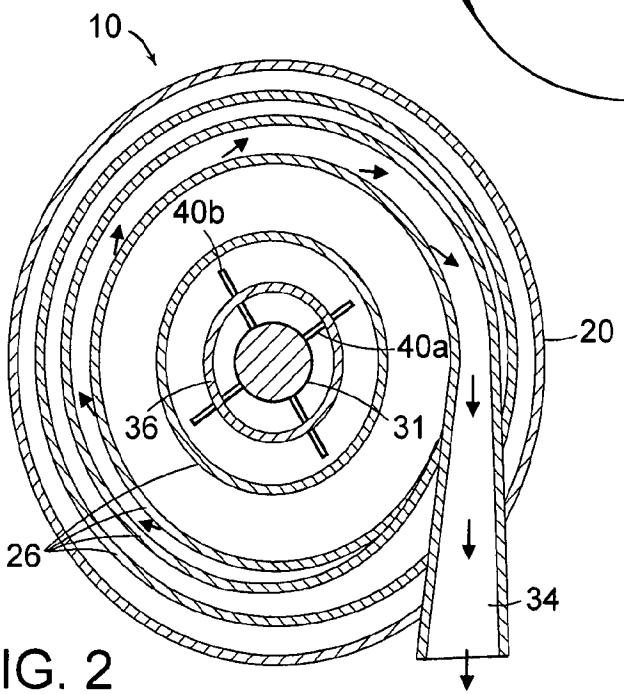
FIG. 2 depicts a cross-sectional view of the fluid transfer controller taken along line 18 in FIG. 1.
Figure 1:
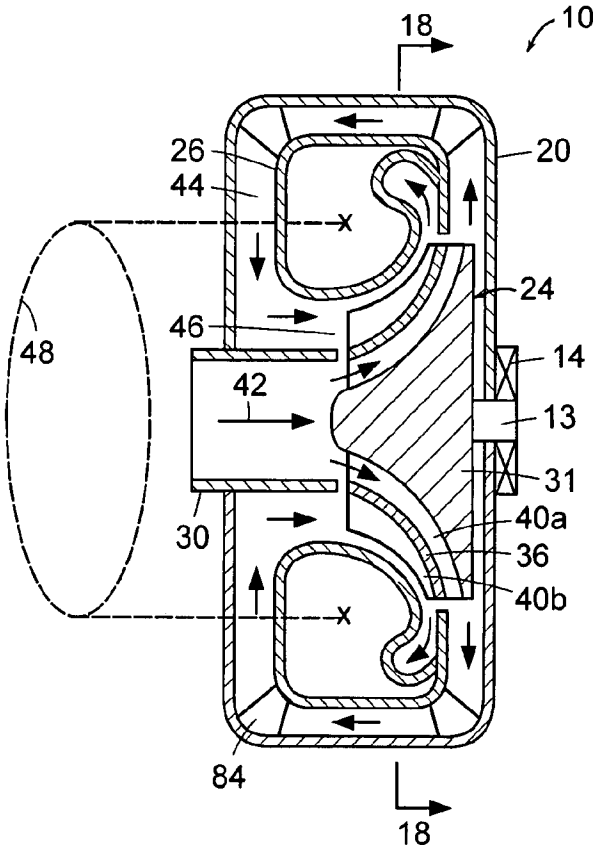
FIG. 1 depicts a cross-sectional view of an exemplary fluid transfer controller having a rotor assembly with multiple levels of rotor blades coupled to a common hub component and enclosed within a casing.

FIG. 1 illustrates a cross-sectional view of fluid transfer controller 10 with rotor assembly 24 having rotor blade sets 40*a* and 40*b* separated by partition 36 and successively coupled to hub component 31. In addition, fluid transfer controller 10 includes barrier components surrounding rotor assembly 24 that are configured to form passages 44 such that fluid may be routed between rotor blade sets 40*a* and 40*b* as described in more detail below. FIG. 2 illustrates a different cross-sectional view of fluid transfer controller 10 taken from the viewpoint of line 18 denoted in FIG. 1 (i.e., FIG. 2 illustrates a different cross-sectional view of fluid transfer controller 10 as a whole rather than a cross-sectional view of the cross-section shown in FIG. 1). In general, FIG. 2 is used to show the route of fluid within a collector region of fluid transfer controller 10 subsequent to passing through rotor blade sets 40*a* and 40*b*. FIG. 2 further illustrates fluid transfer controller 10 including outlet 34 for dispensing the fluid.

Figure 5:
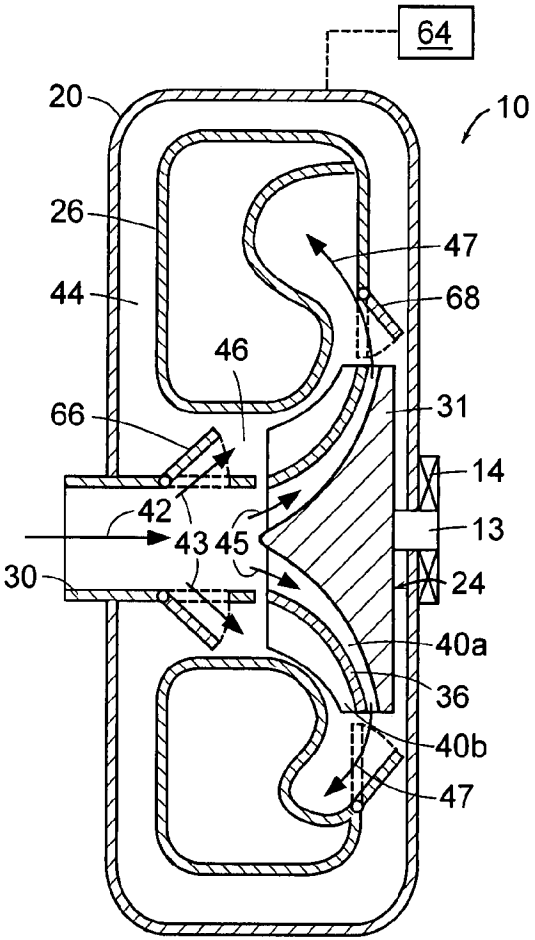
FIG. 5 depicts a cross-sectional view of the fluid transfer controller shown in FIG. 1 having gates disposed along the barrier components and the fluid inlet duct.
Figure 4:
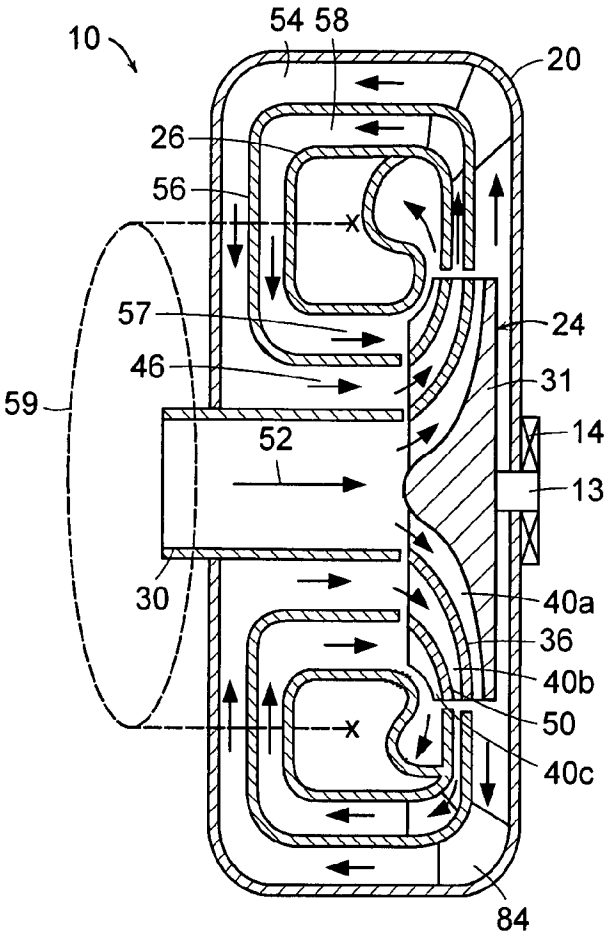
FIG. 4 depicts a cross-sectional view of a different fluid transfer controller having a rotor assembly with multiple levels of rotor blades.

As will be described in more detail below, components other than or in addition to those shown in FIGS. 1 and 2, such as but not limited to additional or alternative barrier and/or coupling components, may be included in fluid transfer controller 10 depending on the design specifications of the device. Consequently, fluid transfer controller 10 is not necessarily restricted to the collection of components illustrated in FIGS. 1 and 2, the shape of a resulting fluid transfer controller depicted in FIG. 2, or the route of fluid flow shown in FIG. 1. For instance, FIG. 5 illustrates an exemplary embodiment in which fluid transfer controller 10 includes gates which may be used to selectively bypass rotor blade set 40*b* or split the entering fluid flow between rotor blade sets 40*a* and 40*b*, in effect altering the route of fluid flow from the one depicted in FIG. 1. In addition, FIG. 4 depicts an alternative embodiment of fluid transfer controller 10 in which rotor assembly 24 includes three sets of rotor blades rather than two sets as depicted in FIG. 1. With regard to such an alternative configuration, it is noted that fluid transfer controller 10 may include any plurality of rotor blade sets and, therefore, is not necessarily limited to the rotor assembly illustrated in FIG. 1 or 4. Furthermore, although the outer periphery of fluid transfer controller 10 is illustrated in FIG. 2 as being circular, fluid transfer controller 10 is not necessarily so limited and may be configured to have any shape.

An enlarged perspective view of an exemplary configuration of rotor assembly 24 is shown in FIG. 3. As shown in FIG. 3, rotor blades 40*a* are coupled to hub component 31 and partition 36 is coupled to the edges of rotor blades 40*a* opposing hub component 31. In other words, partition 36 is suspended apart from hub component 31 by rotor blades 40*a*. As a result, the widths of rotor blades 40*a* define the spacing between hub component 31 and partition 36 through which fluid will be routed. Rotor assembly 24 further includes rotor blades 40*b* coupled to the side of partition 36 opposing rotor blades 40*a*. As such, rotor assembly 24 may be generally described as having different sets of rotor blades respectively arranged along opposing sides of a dividing structure, partition 36 being the dividing structure for the configuration of rotor assembly 24. In addition, rotor assembly 24 may be described as having multiple sets of rotor blades coupled to a common hub component. More specifically, rotor assembly 24 may be described as having multiple levels of rotor blades coupled by one or more intervening partitions, which are serially stacked upon a hub component of a rotor assembly. As used herein, the reference of "multiple sets of rotor blades" may broadly refer to groupings of rotor blades which are separated by some dividing structure, such as a partition wall or a hub component of a rotor assembly. The reference to "multiple levels of rotor blades," however, is slightly more specific in that it refers to multiple groupings of rotor blades which are separated by partition walls and are successively mounted upon a hub component of a rotor assembly.

As shown in FIGS. 1-3, the edges of rotor blades 40*b* opposing partition 36 may be free from coupling to another component. Such a configuration may be referred to as a non-shrouded rotor assembly since the regions between adjacent blades of rotor blades 40*b* are not connected by a plate spanning therebetween. In alternative embodiments, however, rotor assembly 24 may include a plate coupled to the edges of rotor blades 40*b* opposing partition 36 and, therefore, may be configured as a shrouded rotor assembly in some cases. In any case, hub component 31, partition 36, and any plate shrouding rotor blades 40*b* (if used) may, in some embodiments, include similar outer diameters. In other embodiments, however, one or all of hub component 31, partition 36, and any plate shrouding rotor blades 40*b* (if used) may include different outer diameters. Similarly, the area to which rotor blades 40*a* and 40*b* radially extend may include similar or different diameters relative to hub component 31, partition 36, and/or any plate shrouding rotor blades 40*b* (if used). Moreover, the lengths to which rotor blades 40*a* and 40*b* radially extend may be the same or different relative to each other. As a result, the distance fluid is routed through each of rotor blade sets 40*a* and 40*b* (also referred herein as the working area of the individual sets of rotor blades) may be different or the same. In general, the working area of a rotor blade set affects the degree to which fluid velocity and/or pressure is increased therethrough. Consequently, the degree of fluid velocity and/or pressure obtainable by rotor assembly 24 may be optimized by varying the lengths to which rotor blades 40*a* and 40*b* radially extend.

It is noted that although the outer periphery of rotor assembly 24 is illustrated in FIGS. 2 and 3 as being circular, rotor assembly 24 is not necessarily so limited. Rather, the outer periphery of rotor assembly 24 (i.e., the periphery of partition 36 and hub component 31 as well as the boundary to which rotor blades 40*a* and 40*b* extend) may be configured to have any shape. In general, the width dimensions of rotor assembly 24 (i.e., the dimensions to which rotor blades 40*a* and 40*b* radially extend and the peripheral dimensions of partition 36 and hub component 31) may vary widely for different design implementations. In addition, the components of rotor assembly 24 (including shaft 13 and/or bearing 14 as described below) may be coupled together in a number of manners. For instance, any one or more of the components of rotor assembly 24 may be cast together as a single body. In addition or alternatively, any one or more of the components may be removably attached.

In some cases, rotor assembly 24 may include more than two sets of rotor blades. In particular, rotor assembly 24 may, in some embodiments, include one or more additional sets of rotor blades sequentially arranged adjacent to and separated from rotor blades 40*b* by one or more partitions. An exemplary configuration of a rotor assembly having more than two rotors is illustrated and described in reference to the alternative embodiment of fluid transfer controller 10 described in reference to FIG. 4. In addition or alternatively, rotor assembly 24 may include one or more sets of rotor blades mounted on the side of hub component 31 opposing rotor blades 40*a* and 40*b*. Exemplary configurations of rotor assemblies with such a configuration are shown in FIGS. 6*a*-8 and are described in more detail below.

In any case, as noted above, the degree of fluid flow acceleration in a centrifugal rotor assembly is largely affected by the configuration of the blades on the rotor, including the lengths of the rotor blades as noted above as well as the shape, width, number, orientation, and spacing of the rotor blades. In particular, by orienting blades in a particular manner and molding the rotor blades into particular shapes (e.g., twisting or leaning the blades), fluid introduced into a rotor assembly can be directed in a specific manner by the rotor and a desired degree of fluid acceleration can be obtained. In some cases, rotor blade sets 40*a* and/or 40*b* may be configured to change a condition of a fluid by fluid acceleration. In particular, rotor blade sets 40*a* and/or 40*b* may be configured to change a physical parameter of a fluid, such as pressure and fluid velocity as noted above as well as temperature and/or measure of fluid turbulence. In addition or alternatively, rotor blade sets 40*a* and/or 40*b* may be configured to change the physical state of a fluid, such as from a gas to a liquid or vice versa. In some cases, rotor blades 40*a* and 40*b* may be dimensioned to run at a particular Mach number to obtain such changes in physical conditions of a fluid and/or for optimum performance of fluid transfer controller 10. As noted above, a fluid, as referred to herein, may include a gas, liquid, any combination of a gas and a liquid, or any combination of a solid with a liquid or gas. In other words, a fluid may be any matter which is capable of flowing. Exemplary configurations of rotor blades which may be particularly applicable for gas-liquid mixtures are described in U.S. Pat. No. 6,589,013, which issued on Jul. 8, 2003 and is incorporated by reference as if fully set forth herein.

In general, the configurations of rotor blades 40*a* and 40*b* may vary widely, depending on the design specifications of fluid transfer controller 10. As such, the configuration of rotor blades 40*a* and 40*b* are not necessarily restricted to the illustrations in the figures. In particular, rotor blades 40*a* and 40*b* may be oriented radially forward (flow directed into the direction of rotation) or radially backwards (flow directed opposite the direction of rotation). In addition, the shape, size, number, and spacing of rotor blades 40*a* and 40*b* may include any configuration known in the fluid transfer controller industry. In some cases, the shape, size, number, and spacing of rotor blade sets 40*a* and 40*b* may be the same. In other embodiments, however, one or more parameters of rotor blades 40*a* and 40*b* may be different relative to each other. As such, rotor blades 40*a* and 40*b* do not necessarily have to be aligned relative to each other as shown in FIGS. 2 and 3. In some embodiments, the shape, length, and spacing of blades within a single rotor blade set may differ. For example, the lengths of blades within either or both of rotor blades sets 40*a* and 40*b* may, in some embodiments, be split. In particular, the lengths of one or more blades within either or both of rotor blades sets 40*a* and 40*b* may differ relative to each other. Such a configuration of blades may be referred to in the rotor assembly industry as splitters. It is noted that the adaptability of rotor blade sets 40*a* and 40*b* to have a variety of configurations may similarly apply to additional sets of rotor blades which may be included within rotor assembly 24 as well as rotor blade sets within other rotor assembly configurations described herein.

Similar to rotor blade sets 40*a* and 40*b* having the adaptability of different configurations, hub component 31 may, in some embodiments, be configured in a different shape than those shown in FIGS. 1 and 3. In particular, hub component 31 is not restricted to having a conical shape as depicted in FIGS. 1 and 3. Rather, hub component 31 may be a plate or a cylinder, for example. In configurations of a plate, the surface to which rotor blades 40*a* and 40*b* are coupled to hub component 31 may be arranged substantially orthogonal to the direction of fluid flow through fluid inlet duct 30, which is described in more detail below. Alternatively, in embodiments in which hub component 31 is a cylinder, rotor blades 40*a* and 40*b* may be coupled to the outer periphery of the cylinder, which may be aligned substantially parallel with the direction of fluid flow through fluid inlet duct 30. In yet other embodiments, the angle of a conical shaped hub component may be configured to obtain a desired arrangement of the rotor blade sets relative to the direction of fluid flow through fluid inlet duct 30. In addition, the width of the apex portion of a conical shaped hub component and the length to which it extends may be varied to affect the available space upon which to arrange rotor blades.

Regardless of the configurations of hub component 31 and rotor blade sets 40*a* and 40*b*, rotor assembly 24 may include a rotary shaft or may be configured to receive a rotary shaft to provide a rotational axis about which to rotate rotor assembly 24. Such a rotary shaft may be coupled to hub component 31, as depicted in FIG. 1 by shaft 13. Although shaft 13 is shown in FIG. 1 coupled to the side of hub component 31 opposing rotor blade sets 40*a* and 40*b*, the position of shaft 13 is not necessarily so limited. In particular, shaft 13 may be alternatively coupled to the side of the hub component comprising rotor blade sets 40*a* and 40*b*. For instance, shaft 13 may be coupled at the apex of the conical shape of hub component 31 and extend through fluid inlet duct 30 when fluid transfer controller 10 is assembled. An exemplary configuration of a fluid transfer controller having a shaft in such a position is illustrated and described in reference to FIG. 7*a*. In the interest of minimizing the length of shaft 13 in the configuration of fluid transfer controller 10 depicted in FIG. 1, however, shaft 13 may be preferably positioned along the side of hub component 31 opposing rotor blades 40*a* and 40*b* as shown in FIG. 1.

In any case, as with rotor assembly 24, the outer periphery of hub component 31 and shaft 13 are not restricted to being circular, but rather may be formed as any shape. In addition, as noted above, hub component 31 may be configured as a cylindrical body in some cases. In such embodiments, hub component 31 and shaft 13 may, in some cases, include the same width dimensions and, consequently, hub component 31 may be considered a portion of shaft 13, rather than a distinct element. In any case, shaft 13 may be coupled to bearing 14, as shown in FIG. 1, for receiving a power source with which to provide the rotational movement to rotor assembly 24.

As noted above, in addition to rotor assembly 24, fluid transfer controller 10 includes barrier components configured to form passages for routing fluid through the multiple sets of rotor blades within rotor assembly 24. The barrier components may include but are not necessarily limited to fluid intake duct 30, outer barrier component 20, and inner barrier component 26, the functions and arrangements of which are outlined below. As shown in FIG. 1, fluid intake duct 30 is arranged substantially aligned and proximate to partition 36 of rotor assembly 24. In particular, fluid intake duct 30 is arranged in close enough proximity such that a majority or, in some embodiments, substantially all of the fluid drawn into fluid intake duct 30 is routed through rotor blades 40*a* as indicated by fluid flow arrows 42 in FIG. 1. In addition, the clearance between fluid intake duct 30 and the inner diameter of partition 36 is sufficient to allow rotor assembly 24 to rotate freely. The clearance may vary between different design applications. As shown in FIG. 1, fluid intake duct 30 may, in some embodiments, protrude from the exterior surface of outer barrier component 20. In other cases, however, fluid intake duct 30 may be flush with the exterior of outer barrier component 20.

Due to the centrifugal force of rotor assembly 24 when rotating, fluid flow introduced at rotor blades 40*a* from fluid intake duct 30 may continue to the tip (i.e., the outer periphery) of rotor blades 40*a*. As shown in FIG. 1, outer barrier component 20 surrounds rotor assembly 24 and together with inner barrier component 26 forms passage 44 extending from the periphery of rotor blades 40*a* to inlet channel 46 leading to rotor blades 40*b*. More specifically, outer barrier component 20 forms an exterior casing for fluid transfer controller 10. In addition, inner barrier component 26 forms an annular blockade positioned within outer casing component 20 and proximate to partition 36 of rotor assembly 24 such that fluid is routed from the periphery of rotor blades 40*a* to a region spaced apart from edges of rotor blades 40*b*. As shown in FIG. 1, inner barrier component 26 and fluid inlet duct 30 produce inlet channel 46 for fluid to flow from passage 44 to rotor blades 40*b*. The centrifugal force of rotor assembly 24 rotating causes fluid to flow from inlet channel 46 to the tip (i.e., the outer periphery) of rotor blades 40*b*. At such a point, the portions of inner barrier component 26 surrounding the periphery of rotor blades 40*b* form a collector (e.g., a volute) to direct the fluid to outlet 34 as shown in FIG. 2. It is noted that the periphery of rotor assembly 24 may be configured to disperse fluid at the periphery of rotor blade sets 40*a* and 40*b* as a primarily radial fluid stream or a fluid stream having a mixed fluid stream (i.e., having radial and axial tendencies).

As with fluid intake duct 30, inner barrier component 26 may be arranged close enough to partition 36 such that a majority of fluid flowing from rotor blades 40*a* is directed along passage 44, rather than directly into the collector region arranged at the periphery of rotor blades 40*b* (unless a gate is opened along inner barrier component 26 to allow fluid flow into the collector region as described below in reference to FIG. 5). In addition, the clearance between inner barrier component 26 and partition 36 as well as the clearance between inner barrier component 26 and rotor blades 40*b* may be sufficient to allow rotor assembly 24 to rotate. Similarly, the clearance between outer barrier component 20 and hub component 31 may be sufficient to allow rotor assembly 24 to rotate. In general, the clearances between respective portions of inner barrier component 26 and partition 36 and rotor blades 40*b* as well as the clearance between outer barrier component 20 and hub component 31 may vary between different design applications.

As shown in FIG. 1, inner barrier component 26 surrounds at least a portion of rotor assembly 24 and, in some cases, portions of fluid intake duct 30. It is noted that the width of inner barrier component 26 may be curtailed or extended relative to the depiction in FIG. 1, particularly near the base of partition 36 or further along fluid intake duct 30. In accordance thereto, outer barrier component 20 may also, in some embodiments, be shortened or extended to maintain passage 44 within a desired width specification. In any case, inner barrier component 26 may, in some embodiments, be configured to have an inner hollow portion as shown in FIG. 1. Such a configuration may be advantageous for minimizing the weight of fluid transfer controller 10. In other embodiments, inner barrier component 26 may not have a hollow central region. In particular, the central region about which inner barrier component 26 is arranged may alternatively include a light weight material to minimize the weight of fluid transfer controller 10. In other embodiments, the central region about which inner barrier component 26 is arranged may include a relatively heavier material, which may be advantageous for offering a higher degree of robustness, particularly for high rates of fluid flow. In any case, the central region about which inner barrier component 26 is arranged may be configured to dampen noise generated from the rotation of rotor assembly 24. In particular, the central region may include a honeycomb interior configuration and/or any noise dampening material, such as foam, for example.

As shown in FIG. 1, fluid transfer controller 10 may, in some embodiments, include vanes 84 extending within passage 44. In general, vanes 84 may be used for guiding fluid through passage 44. More specifically, vanes 84 may be used to lessen the swirling motion of fluid exiting rotor assembly 24. In some embodiments, vanes 84 may further be used to couple barrier components 20 and 26 together. Vanes 84, however, are not necessarily restricted to extending between surfaces of the barrier components as shown in FIG. 1. As such, it is noted that inner barrier component 26 may be additionally or alternatively coupled to outer barrier component 20 by spacers placed along portions of passage 44. In particular, spacers may be used to secure inner barrier component 26 within fluid transfer controller 10, while allowing rotor assembly 24 to rotate adjacent thereto.

Figure 12:
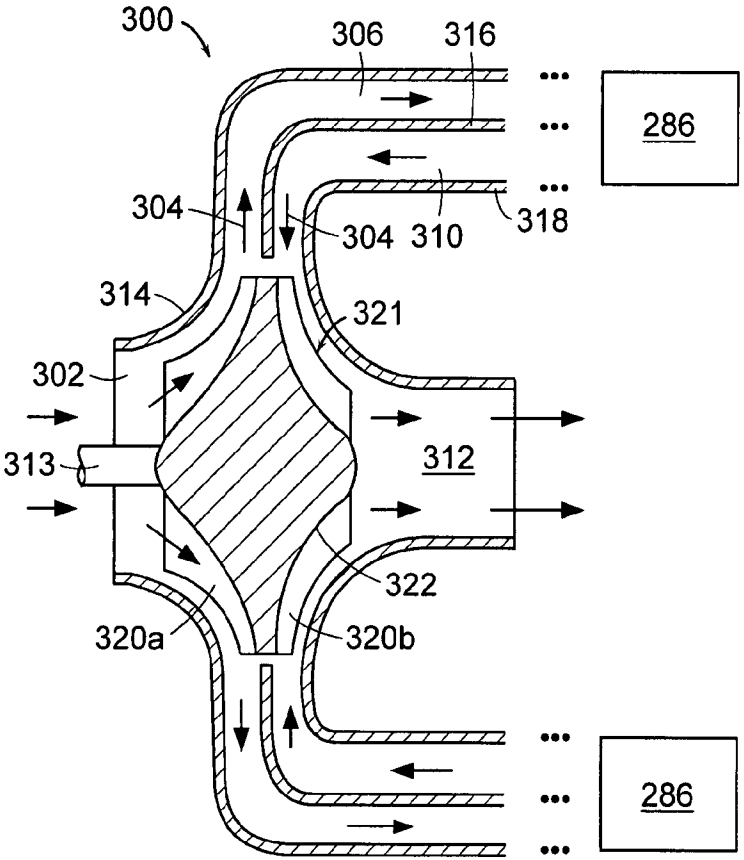
FIG. 12 depicts a cross-sectional view of an exemplary turbo-engine system having yet another configuration of a fluid transfer controller configured for coupling to a thermal energy alteration device.

In some cases, fluid transfer controller 10 may additionally or alternatively include vanes within passages other than passage 44. For example, fluid transfer controller 10 may include vanes within passages formed by intermediate barrier components interposed between barrier components 20 or 26 (as described below in reference to FIG. 4). In addition or alternatively, vanes may be included within fluid inlet duct 30, channel 46, and/or the collection region formed by inner barrier component 26 at the periphery of rotor blades 40*b*. In general, fluid transfer controller 10 may include any number of vanes and, in cases in which the controller includes a plurality of vanes, the vanes may be positioned either uniformly or non-uniformly with respect to each other. In yet other embodiments, vanes may be omitted from fluid transfer controller 10. Consequently, some configurations of fluid transfer controllers described herein may not include vanes, such as, for example, those referenced with respect to FIGS. 5 and 12. It is noted that the omission of vanes in the configurations of fluid transfer controllers depicted in FIGS. 5 and 12 is not exclusive to those configurations nor is the inclusion of vanes within the other fluid transfer controller configurations described herein exclusive to those embodiments. Rather, FIGS. 5 and 12 are merely used to show that the omission of vanes is an option for any of the fluid transfer controllers described herein. In some embodiments, the configurations depicted in FIGS. 5 and 12 may include vanes.

In any case, as shown by fluid flow arrows 42 in FIG. 1, the collective configuration of rotor assembly 24, barrier components 20 and 26, and fluid inlet duct 30 form a spiraled fluid flow route proceeding toward and away from the rotational axis of rotor assembly 24. More specifically, the configuration of components within fluid transfer controller 10 allow fluid to be introduced axially into fluid intake duct 30, routed radially through rotor blades 40*a*, directed along a path winding about inner barrier component 26 alongside rotor assembly 24, routed radially through rotor blades 40*b*, and collected at the periphery of rotor blades 40*b*. The passage winding about inner barrier component 26 alongside rotor assembly 24 is specifically configured to first route fluid in a direction opposing the rotational axis of rotor assembly 24 and then in a direction opposing the axial fluid flow in fluid intake duct 30 as shown in FIG. 1 by fluid flow arrows 42. Thereafter, the passage is configured to route the fluid in a direction toward fluid intake duct 30 and then in a direction parallel to the fluid flow in fluid intake duct 30 leading to rotor blades 40*b*.

As a result, fluid is routed in a spiraled pattern about annular reference 48, the approximate position of which is denoted by "x"es in FIG. 1. It is noted that the "x"es and dotted lines in FIG. 1 are merely used to reference the approximate location of annular reference 48 and, therefore, should not be presumed to be structural components of fluid transfer controller 10. As shown in FIG. 1, annular reference 48 is spaced about fluid intake duct 30 or, in other words, on the same side of partition 36 as fluid intake duct 30. A spiral pattern of fluid flow about an annular reference in such a relative location to a fluid intake is referred to herein as a "backward spiral fluid flow route". Alternatively, the fluid flow route pattern induced by the configuration of fluid transfer controller 10 may be described as an involute centered about annular reference 48. With either description of the fluid flow route through fluid transfer controller 10, the configuration of rotor assembly 24 and barrier components 20 and 26 allows fluid to be routed through two sets of rotor blades, namely rotor blades 40*a* and 40*b*, without being collected and dispensed through an outlet therebetween. As a consequence, the increase of fluid velocity and/or pressure generated from a fluid transfer controller with such a configuration may be larger than one with a rotor of the same size and similar blade configuration, but only having a single level of rotor blades.

In addition to offering increased fluid velocity and/or pressure relative to fluid transfer controllers having a rotor with only a single level of rotor blades, a fluid transfer controller with a spiral (or involute) fluid flow route pattern and, more specifically, the fluid transfer controller configurations described herein may be advantageous over conventional fluid transfer systems employing serially arranged fluid transfer controllers. In particular, a fluid transfer controller configured with a spiral fluid flow route may be more efficient and smaller than a system having conventional fluid transfer controllers arranged in series. Furthermore, the costs associated with fabricating and maintaining a fluid transfer controller configured with a spiral fluid flow route may be less than a system having conventional fluid transfer controllers arranged in series. A particular cost saving benefit is that a relatively short rotational shaft may be used within a fluid transfer controller having a spiral fluid flow route as compared to a system having conventional fluid transfer controllers arranged in series and sharing the same rotational shaft.

A further benefit of a fluid transfer controller configured with a spiral fluid flow route over a system having conventional fluid transfer controllers arranged in series is lower noise generation. In particular, in addition to providing barriers with which to route fluid into and around rotor assembly 24, the arrangement of barrier components 20 and 26 and fluid inlet duct 30 may further dampen noise generated from the rotation of the rotor assembly 24 and the passage of fluid through rotor assembly 24. Although not necessarily needed, any or all of barrier components 20 and 26 and fluid inlet duct 30 may include a honeycomb interior configuration and/or any noise dampening material to further reduce noise.

As will be described in more detail below, a spiral (or involute) fluid flow route pattern may be designed within other fluid transfer controller configurations and, therefore, is not necessarily specific to the configuration of fluid transfer controller 10. In particular, as noted below, alternative design configurations for rotor assembly 24 and/or barrier components 20 and/or 26 may be employed, such as but not limited to those described in reference to FIGS. 4, 6*a*-8, 11, 13, and 14. In addition, the direction to which fluid may be routed into the spiral pattern with respect to the fluid intake of the fluid transfer controller may be modified in comparison to the illustration in FIG. 1. Exemplary fluid transfer controllers with such a modification are described in reference to FIGS. 6*a*-7*b*, 13, and 14. Furthermore, the configuration of a spiral (or involute) fluid flow route pattern is not necessarily specific to fluid transfer controllers of a specific function. In particular, although fluid transfer controller 10 is described above as being configured to function as a compressor, pump, blower, or turbocharger, a spiral (or involute) fluid flow route pattern may additionally or alternatively be employed within a turbo engine as described in reference to FIGS. 11, 13, and 14.

Although the spiral fluid flow route within fluid transfer controller 10 is specifically described above with reference to rotor assembly 24 having two sets of rotor blades 40*a* and 40*b* for the successive passage of fluid, fluid transfer controller 10 is not necessarily so limited. In particular, fluid transfer controller 10 may include any plurality of rotor blade sets to pass fluid therethrough. FIG. 4 illustrates an alternative configuration of fluid transfer controller 10 in an embodiment which rotor assembly 24 includes three sets of rotor blades. In particular, FIG. 4 depicts rotor assembly 24 having rotor blade set 40*c* in addition to rotor blade sets 40*a* and 40*b*. As shown in FIG. 4, rotor blade set 40*c* may be arranged adjacent to and separated from rotor blade set 40*b* by partition 50. Although not illustrated in FIG. 4, additional sets of rotor blades and one or more intervening partitions may be incorporated within fluid transfer controller 10 in some embodiments. In such cases, the additional sets of rotor blades and separating partitions may be sequentially arranged within rotor assembly 24 adjacent to rotor blade set 40*c* in a manner similar to the arrangement of rotor blade set 40*c* and partition 50 relative to rotor blade set 40*b*.

As with the configuration illustrated in FIG. 1, fluid transfer controller 10 depicted in FIG. 4 includes fluid intake duct 30 substantially aligned and proximate to partition 36 such that fluid may be routed through rotor blade set 40*a*. In addition, fluid transfer controller 10 includes barrier components 20 and 26 having a similar construction as depicted in FIG. 1 with the exception that outer barrier component 20 may be larger and/or inner barrier component 26 may be smaller due to the inclusion of intermediate barrier component 56 interposed therebetween, as described in more detail. Furthermore, due to the inclusion of rotor blade set 40*c* within rotor assembly 24, the relative placement of inner barrier component 26 differs slightly from its placement illustrated in FIG. 1. In particular, inner barrier component 26 is arranged adjacent to the edges of rotor blades 40*c* and is arranged proximate to partition 50 at the periphery of rotor assembly 24 as shown in FIG. 4.

In addition to the altered placement of inner barrier component 26, the configuration of fluid transfer controller depicted in FIG. 4 includes intermediate barrier component 56 disposed between barrier components 20 and 26 such that distinct passages are formed for routing fluid between rotor blade sets 40*a* and 40*b* and between rotor blade sets 40*b* and 40*c*, respectively. In particular, intermediate barrier component 56 together with outer barrier component 20 forms passage 54 extending from the periphery of rotor blade set 40*a* to inlet channel 46 leading to rotor blade set 40*b*. In addition, intermediate barrier component 56 and inner barrier component 26 collectively form passage 58 extending from the periphery of rotor blade set 40*b* to inlet channel 57 leading to rotor blade set 40*c*. In this manner, barrier components 20, 26, and 56 form passages for successively routing fluid among neighboring levels of the rotor blade sets. Other configurations of barrier components, however, may be considered for routing fluid among non-neighboring levels of rotor blade sets.

Due to the centrifugal force of rotor assembly 24 and the formation of passages 54 and 58, fluid is routed in a spiral pattern proceeding away from and toward the rotational axis of rotor assembly 24 as shown by fluid flow arrows 52 in FIG. 4. More specifically, fluid is routed in a spiral pattern about annular reference 59, which is spaced about fluid intake duct 30 or, in other words, on the same side of partition 36 as fluid intake duct 30. At the periphery of rotor blades 40*c*, portions of inner barrier component 26 form a collector to direct the fluid to an outlet, similar to the configuration for inner barrier component 26 depicted in FIG. 2. As noted above, fluid transfer controller 10 may include any number of rotor blade sets. To accommodate the additional sets of rotor blades, fluid transfer controller 10 may include additional barrier components similar to the configuration of intermediate barrier component 56 to form additional passages to route fluid into the additional rotor blade sets, and, in some cases, in a backward spiral fluid flow route.

Regardless of the number of rotor blade sets included therein, fluid transfer controller 10 may, in some embodiments, be configured to optionally bypass one or more of the rotor blade sets and possibly portions of the passages connecting the sets of rotor blades. For example, in reference to fluid transfer controller 10 having two sets of rotor blades 40*a* and 40*b* as described with respect to FIG. 1, barrier component 26 may include one or more gates such that fluid passing from rotor blades 40*a* may be routed more directly to the collector region at the periphery of rotor blades 40*b*. In addition or alternatively, any intermediate barrier components of a fluid transfer controller having more than two levels or rotor blades, such as intermediate barrier component 56 depicted in FIG. 4, for example, may include one more gates for routing fluid between neighboring passageways around a rotor assembly. Furthermore, fluid inlet duct 30 may additionally or alternatively include one or more gates to partially or wholly bypass rotor blade set 40*a*.

FIG. 5 depicts an alternative configuration of the fluid flow controller 10 depicted in FIG. 1 in which inner barrier component 26 includes gates 68 and fluid inlet duct 30 includes gates 66. FIG. 5 further shows resultant fluid flow paths 43 and 47 when gates 66 and 68 are respectively opened. In particular, FIG. 5 shows fluid flow path 43 leading from inlet fluid stream 42 through gates 66 such that rotor blade set 40*a* and passage 44 are bypassed and fluid is routed directly to rotor blades 40*b*. As will be described in more detail below, fluid transfer controller 10 may be configured such that fluid flow is either routed entirely to rotor blades 40*b* when gates 66 are open or split between being directly routed to rotor blades 40*a* and 40*b* when gates 66 are open. In particular, fluid transfer controller 10 may include a blocking gate at the inlet of rotor blade set 40*a* which may be operated in conjunction gates 66 to block fluid flow through rotor blade set 40*a*. In other cases, the blocking gate may not be used when gates 66 are opened or may be omitted from fluid transfer controller 10 entirely. Consequently, in such embodiments, fluid flow may be split between rotor blades 40*a* and 40*b*. In any case, FIG. 5 further shows fluid flow path 47 leading from inlet fluid stream 42 to fluid streams 45 passing through rotor blades 40*a* and traversing through gates 68 to the collector region formed by inner barrier component 26 arranged near the periphery of rotor blades 40*b*. In effect, gates 68 allow passage 44 and rotor blade set 40*b* to be bypassed.

As described in more detail below, the opening and closing of gates 66 and 68 may depend on the operation of fluid transfer controller 10 and, therefore, the gates do not necessarily need to be opened at the same time as shown in FIG. 5. In addition, the inclusion of gates 66 and 68 within fluid transfer controller 10 are not necessarily mutually exclusive. In particular, fluid transfer controller 10 may alternatively include either one but not both of gates 66 and 68. Furthermore, the placement of gates 66 and 68 along fluid inlet duct 30 and inner barrier component 26 is not limited to the depiction of FIG. 5. For example, gates 68 may be placed along any portion of inner casing component 26 lining its collector region. Furthermore, the placement of gates 66 along fluid intake duct 31 may be closer or further from rotor assembly 24. Moreover, the lengths of gates 66 and 68 may vary with the design specifications of fluid transfer controller 10. In some cases, gates 66 and 68 may be respectively configured to come in close proximity to or in contact with barrier components 26 and 20 when fully opened.

In any case, fluid inlet duct 30 and inner barrier component 26 may include any number of gates, including a single gate or any plurality of gates. In some cases, gates 66 and/or 68 may depict a single gate disposed along the peripheries of fluid intake duct 30 and inner barrier component 26, respectively. In other embodiments, however, gates 66 and/or 68 may depict distinct gates along fluid intake duct 30 and/or inner barrier component 26. In such cases, the arrangement of a plurality of gates within a respective component may be uniform or may be random with respect to each other. It is noted that the number and placement of gates 66 and 68 as well as their open configuration in FIG. 5 is merely to show the optional inclusion of either or both sets of gates as well as their respective effects on fluid flow through fluid transfer controller 10. Furthermore, the depiction of the gates within a single figure of the fluid transfer controllers described herein is for the sake of brevity and, thus, gates may be included within the fluid transfer controllers described in reference to FIGS. 1, 2, 4, and 6*a*-14. Moreover, the inclusion of gates within the fluid transfer controllers described herein should not be restricted to the depiction in FIG. 5.

As shown in FIG. 5, the spiral fluid flow pattern described in reference to FIG. 1 may be partially or wholly relinquished when gates 66 and/or 68 are opened. In particular, the extent to which gates 66 and 68 are opened may vary and, thus, in some embodiments, the amount of fluid flowing through gates 66 and 68 may vary. Moreover, in embodiments in which gates 66 and/or 68 include a plurality of gates, the number of open gates within each respective set of gates 66 and 68 may differ, causing the amount of fluid bypassing portions of passage 44 and rotor blades 40*a* or 40*b* to vary. In some embodiments, substantially all fluid may be routed to follow fluid flow path 43. In such cases, fluid inlet duct 30 may optionally include an additional blocking gate configured to close the duct's opening aligned and proximate to partition 36 such that no fluid may be routed to rotor blades 40*a* when gates 66 are open. In such cases, the additional blocking gate and gates 66 may be programmed to work in conjunction with each other. In other cases, substantially all fluid may be routed to follow fluid flow paths 45 and 47. Alternatively, fluid may be split between flowing along any number of fluid flow paths 42, 43, 45, and 47 (fluid flow path 42 is depicted of FIG. 1). In yet other embodiments, gates 66 and 68 may be closed and, thus, the fluid may follow the route of fluid flow path 42 as described in reference to FIG. 1. Such variability in fluid flow routes leads to variability in the degree to which fluid velocity and/or pressure is increased within fluid transfer controller 10 for a given revolution rate of rotor assembly 24. As a consequence, rotor assembly 24 may be run with fewer changes in revolution rates, placing less stress on fluid transfer controller 10 while still allowing variable performance by the fluid transfer controller.

In any case, the opening and closing of gates 66 and 68 may, in some embodiments, depend on operation criteria set for fluid transfer controller 10, such as but not limited to power demand levels, overheating limits, and/or time-scheduled sequences. As such, gates 66 and 68 may be configured to open and/or close prior to operating fluid transfer controller 10 and/or during operation of fluid transfer controller 10. In addition, the timing and degree at which to open and/or close gates 66 and 68 may be the same or different relative to each other. In some embodiments, the opening and closing of gates 66 and/or 68 may be administrated by human intervention (i.e., an operator of fluid transfer controller 10 may decide when and/or to what degree to open and/or close gates 66 and/or 68). In such cases, the physical act of opening and closing gates 66 and/or 68 may be manual or automated (i.e., controlled through use of program instructions which are executable by a processor of a computer). In other embodiments, the timing and/or degree to which gates 66 and/or 68 are opened and closed may be computer-controlled and, as such, the operation of gates 66 and/or 68 may lack human intervention. In some embodiments, the timing and/or degree to which gates 66 and/or 68 are opened and closed may be administered by both human intervention and by computer-controlled program instructions. In particular, fluid transfer controller 10 and/or a system comprising fluid transfer controller 10 may include configurations to set the manner in which to control the gates.

In any case, fluid transfer controller 10 may, in some embodiments, include or may be configured to access storage medium 64 comprising program instructions as shown in FIG. 5. In general, the term "storage medium", as used herein, may refer to any electronic medium configured to hold one or more sets of program instructions, such as a read-only memory, a random access memory, a magnetic or optical disk, or magnetic tape. The term "programming instructions" may generally refer to commands within a program to perform a particular function, such as opening and closing gates 66 and/or 68, for example. In general, storage medium 64 may be coupled to the components of fluid transfer controller 10 which it is configured to control (e.g., gates 66 and/or 68). Such individual connections to the components, however, are not illustrated in FIG. 5 to simplify the drawing. Rather, storage medium 64 is shown coupled to fluid transfer controller 10 by a dotted line to show a general connection to the components included within the fluid transfer controller.

Although storage medium 64 is specifically referenced for use in controlling gates of fluid transfer controller 10, the system is not necessarily so limited. In particular, storage medium 64 may include program instructions for operating other components of fluid transfer controller 10, such as but not limited to the rotation of rotor assembly 24. Furthermore, the inclusion of storage medium 64 may is not necessarily exclusive to embodiments in which fluid transfer controller 10 includes gates. Consequently, although the depictions fluid transfer controller 10 in FIGS. 1 and 4 as well as the depictions of other fluid transfer controllers in other figures described herein do not include a storage medium coupled thereto, the controllers are not necessarily void of such a component.

Figure 6A:
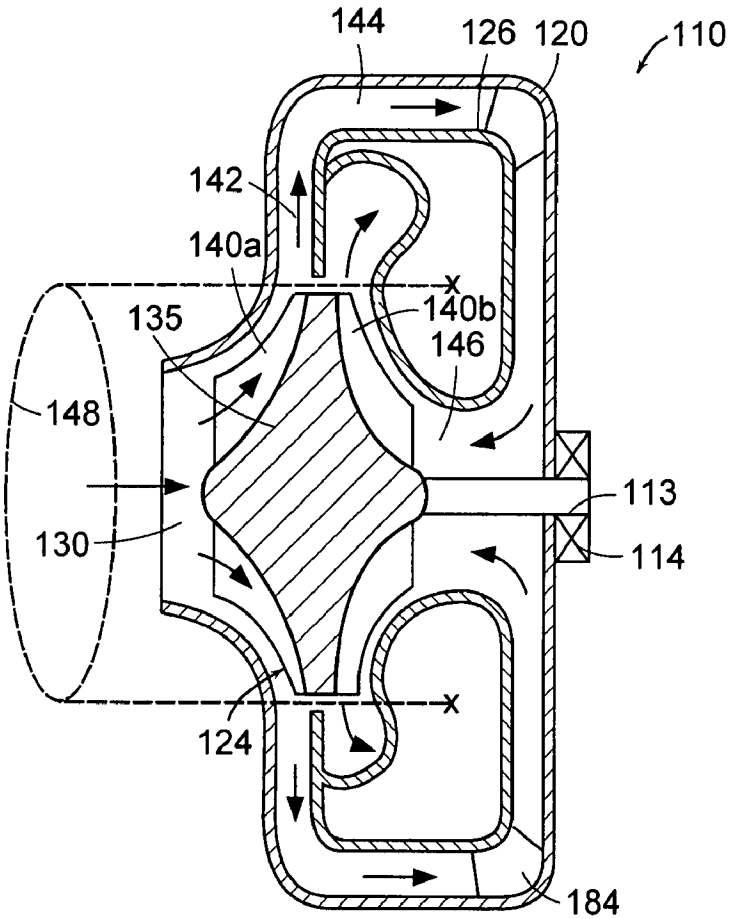
FIG. 6*a* depicts a cross-sectional view of an exemplary fluid transfer controller having a rotor assembly with different sets of rotor blades respectively coupled to opposing sides of a common hub component.

An alternative configuration of a fluid transfer controller is illustrated in FIG. 6*a*. In particular, FIG. 6*a* illustrates fluid transfer controller 110 having rotor assembly 124 with rotor blade sets 140*a* and 140*b* coupled to opposing sides of hub component 135. As such, hub component 135 serves as a dividing structure between the different sets of rotor blades. As with rotor blades 40*a* and 40*b* described in reference to fluid transfer controller 10, the shape, size, number, spacing, and direction of rotor blades 140*a* and 140*b* may include any configuration known in the fluid transfer controller industry. In addition, the configuration of rotor blades 140*a* and 140*b* do not necessarily have to be similar. As will be described in more detail below in reference to FIG. 7*a*, an alternative configuration of rotor assembly 124 may include multiple levels of rotor blades sets in some embodiments.

As shown in FIG. 6*a*, fluid transfer controller 110 further includes outer barrier component 120 and inner barrier component 126 configured to form passage 144 for routing fluid in succession through rotor blade sets 140*a* and 140*b*. In some cases, fluid transfer controller 110 may include vanes 184 within passage 144 as shown in FIG. 6*a* for guiding fluid flow therethrough. In other embodiments, vanes 184 may be omitted from fluid transfer controller 110. In either case, outer barrier component 120 may form fluid inlet 130 along the side of hub component 135 comprising rotor blade set 140*a*. As shown in FIG. 6*a*, fluid inlet 130 may simply be an opening within outer barrier component 120 and, therefore, may not include a duct as described in reference to fluid transfer controller 10 in FIGS. 1-5. In other embodiments, fluid inlet 130 may include a fluid intake duct. In either case, fluid inlet 130 may protrude from the sidewalls of outer barrier component 120 as shown in FIG. 6*a* or may be flush with the sidewalls of outer barrier component 120 adjacent to the portion of inner barrier component 126 at the periphery of rotor blades 140*a*.

As shown by fluid flow arrows 142 in FIG. 6*a*, fluid may be drawn in axially through fluid inlet 130, pass radially through rotor blades 140*a*, move through passage 144 between barrier components 120 and 126 to inlet channel 146, and pass radially through rotor blades 140*b* to a collector and eventually to an outlet of fluid transfer controller 110. Passage 144 is particularly configured to first route fluid in a direction opposing rotor assembly 124 and then in the same direction as the axial fluid flow entering fluid inlet 130. Subsequent thereto, passage 144 routes fluid in a direction toward the rotational axis of rotor assembly 124 and then in a direction opposing the direction of flow in fluid inlet 130. As a result, fluid transfer controller 110 is configured to route fluid in a spiral pattern about annular reference 148, the approximate position of which is denoted by the "x"es on the side of hub component 135 opposing fluid inlet 130 in FIG. 6*a*. A spiral pattern of fluid flow about an annular reference in such a relative location to a fluid intake is referred to herein as a "forward spiral fluid flow route", the contrary of which is shown in FIGS. 1 and 5 and referred to as a "backward spiral fluid flow route".

In order to accommodate a forward spiral fluid flow route configuration, inner barrier component 126 is arranged as a mirror image to the arrangement of inner casing component 26 in FIG. 1. In particular, inner barrier component 126 is aligned with hub component 135 and extends back toward the side of outer barrier component 120 opposing fluid inlet 130 as shown in FIG. 6*a*. In general, the clearance between inner barrier component 126 and hub component 135 and the clearance between inner barrier component 126 and rotor blades 140*b* may be sufficient to allow rotor assembly 124 to rotate. Similarly, the clearance between rotor blades 140*b* and outer barrier component 120 may be sufficient to allow rotor assembly 124 to rotate. In addition, the clearance between inner barrier component 126 and hub component 135 may be close enough to primarily route fluid to passage 144 instead of directly to the collector region of inner barrier component 126 (expect in cases in which barrier component 126 includes an opened gate as described in more detail below). Generally, the respective clearances between inner barrier component 126 and hub component 135 and rotor blades 140*b* as well as the clearance between outer barrier component 120 and rotor blades 140*a* may vary between different design applications.

It is noted that the configuration of fluid transfer controller 110 inducing a forward spiral pattern fluid flow route offers similar benefits of a fluid transfer controller configured for backward spiral fluid flow described in reference to FIGS. 1 and 5. In particular, a fluid transfer controller configured with a forward spiral fluid flow will generally realize increased fluid velocity and/or pressure generation as compared to conventional fluid transfer controllers of the same size and blade configuration, but only having a single set of rotor blades. In addition, a fluid transfer controller configured with a forward spiral fluid flow route may be more efficient and smaller than a system having conventional fluid transfer controllers arranged in series. Furthermore, the costs associated with fabricating and maintaining a fluid transfer controller configured with a forward spiral fluid flow route may be less than a system having conventional fluid transfer controllers arranged in series. A further benefit of a fluid transfer controller configured with a forward spiral fluid flow route over a system having conventional fluid transfer controllers arranged in series is lower noise generation. In particular, in addition to providing barriers with which to route fluid into and around rotor assembly 124, casing components 120 and 126 may further dampen noise generated from the rotation of the rotors and the passage of fluid through rotor assembly 124. Although not needed, any or all of such casing components may include a honeycomb interior configuration and/or any noise dampening material to further reduce noise.

One of the advantages of the configurations of fluid transfer controller 110 (i.e., one of the advantages of a fluid transfer controller having configurations for inducing a forward spiral fluid flow route) is that for a given size fluid transfer controller the width of fluid inlet 130 may be larger than that for fluid transfer controller 10 described in reference to FIG. 1. In particular, since fluid inlet 130 need not be aligned with a partition separating different levels of rotor blades as in the configuration of fluid transfer controller 10, the width of fluid inlet 130 may be relatively larger than the width of fluid inlet duct 30 of fluid transfer controller 10. A larger fluid inlet width may offer more power for a fluid transfer controller of a given size and operated at a given rpm. Furthermore, the choking point of a fluid transfer controller may be extended with increases in fluid inlet width. In general, the choking point of a fluid transfer controller refers to conditions at which the volume of fluid passing through the controller cannot be increased by operational changes.

In some cases, the advantages of having a relatively wide fluid inlet width within fluid transfer controllers configured with a forward-spiral fluid flow route as compared to those configured for a backward spiral fluid flow route may be particularly noteworthy in comparisons of fluid transfer controllers having rotor blades arranged orthogonal to a fluid inlet. As noted above, the fluid transfer controllers described herein are not restricted to having conical hub components and, therefore, are not limited to having rotor blades arranged at a slant relative to fluid inlets of the controllers. In particular, the fluid flow controllers described herein may alternatively have rotor blade sets arranged in parallel with a fluid inlet or orthogonal to a fluid inlet. In configurations in which rotor blades are arranged orthogonal to a fluid inlet, a fluid transfer controller configured for a backward spiral fluid flow route (such as described in reference to fluid transfer controller 10) generally has a fluid inlet duct aligned in proximity to an opening within a partition of a rotor assembly. Rotor blade sets are arranged upon opposing sides of the partition and, consequently, the length of the rotor blade sets arranged on the side adjacent to and orthogonal to the fluid inlet duct are limited. As such, for a given fluid transfer controller of a given size, there is trade off between the width of a fluid intake duct and the distance fluid passes through the rotor blades of the rotor assembly (i.e., the working area of the rotor blades) in designing a fluid transfer controller having a backward spiral fluid flow route and rotor blades arranged orthogonal to a fluid intake duct.

In the configuration of a fluid transfer controller configured for a forward spiral fluid flow route, however, the size of the fluid intake channel may be independent of the working area of the rotors on the opposing side of the hub component of the rotor assembly since their lengths are not interrupted by the incorporation of a fluid inlet duct in proximity thereto. In some cases, the length of the rotor blades on the side of the hub component facing the fluid intake channel in such a configuration may be reduced in order to accommodate a larger width of a fluid inlet. Although the working area of the rotor blades may be reduced by such a configuration, having fluid routed subsequently through multiple sets of rotor blades which do not have restricted working areas as allowed by a forward spiral fluid flow route configuration may compensate for such a reduction. In effect, a fluid transfer controller having a forward spiral fluid flow route configuration may be configured to produce a desired increase in fluid velocity and/or pressure, while maximizing the width of the fluid inlet and, thus, maximizing the power which may be generated from the fluid transfer controller.

In some cases, inner barrier component 126 may include one or more gates, similar to gates 68 described in reference to FIG. 5. The inclusion of gates within inner barrier component 126 may allow fluid to be routed directly into the collection region at the periphery of rotor blades 140*b* without passing through rotor blades 140*b*. As with gates 68, the timing and/or degree to which the gates along inner barrier component 126 are opened and/or closed may be manual or may be programmed. In addition, the degree to which the gates are opened may vary. As such, fluid flow may be split between being routed directly into the collection region at the periphery of rotor blades 140*b* and routed through rotor blades 140*b*. Alternatively, the gates may be configured to route substantially all of the fluid directly into the collection region at the periphery of rotor blades 140*b*. In yet other embodiments, the gates may be closed. In any case, the gates may advantageously allow variability in the degree to which fluid velocity and/or pressure is increased within fluid transfer controller 110 for a given revolution rate of rotor assembly 124. As a consequence, rotor assembly 124 may be run with fewer changes in revolution rates, placing less stress on fluid transfer controller 110.

Figure 7A:
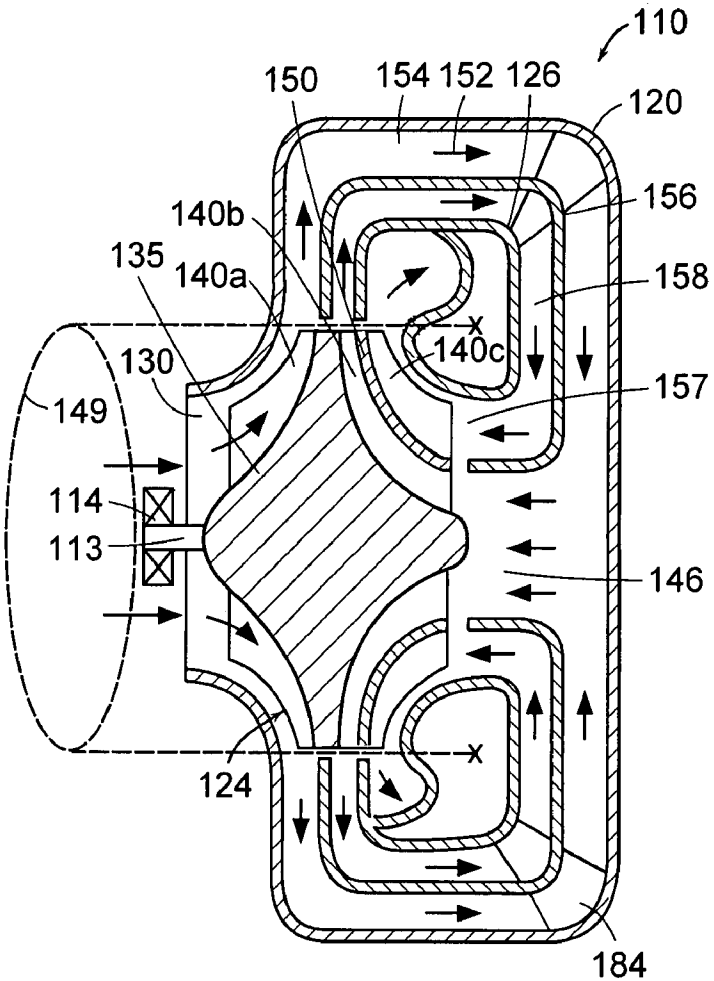
FIG. 7*a* depicts a cross-sectional view of an exemplary fluid transfer controller having a rotor assembly with multiple levels of rotor blades coupled to one side of a hub component and another set of rotor blades coupled to the opposing side of the hub component.

As with fluid transfer controller 10 described in reference to FIGS. 1-5, fluid transfer controller 110 may include any number of sets of rotor blades. An exemplary configuration of fluid transfer controller 110 having an additional set of rotor blades relative to the configuration illustrated in FIG. 6*a* is depicted in FIG. 7*a*. In particular, FIG. 7*a* illustrates fluid transfer controller 110 having rotor blades 140*c* spaced adjacent to rotor blades 140*b* by partition 150 and, therefore, illustrates an embodiment in which fluid transfer controller 110 includes multiple levels of rotor blade sets. In such an embodiment, fluid transfer controller 110 further includes intermediate barrier component 156 in addition to barrier components 120 and 126 to provide passages for routing fluid from rotor blade set 140*a* to rotor blade set 140*b* and from rotor blade set 140*b* to rotor blade set 140*c*, respectively. In particular, intermediate barrier component 156 together with outer barrier component 120 forms passage 154 extending from the periphery of rotor blade set 140*a* to inlet channel 146 leading into rotor blade set 140*b*. In addition, intermediate barrier component 156 and inner barrier component 126 collectively form passage 158 extending from the periphery of rotor blade set 140*b* to inlet channel 157 leading into rotor blade set 140*c*.

As shown in FIG. 7*a*, barrier component 156 is disposed between inner barrier component 126 and outer barrier component 120 and is aligned with the periphery of hub component 135 and the portion of partition 150 adjacent to inlet channels 146 and 157. Inner barrier component 126 in FIG. 7*a* differs slightly from its position in FIG. 6*a* in that it is aligned with partition 150 rather than hub component 135. Due to the centrifugal force of rotor assembly 124 and the formation of passages 154 and 158, fluid is routed in a spiral pattern proceeding away from and toward the rotational axis of rotor assembly 124 as shown by fluid flow arrows 152 in FIG. 7*a*. More specifically, fluid is routed in a spiral pattern about annular reference 149, the approximate position of which is denoted by the "x"es on the side of hub component 135 opposing fluid inlet 130 in FIG. 7*a*.

Although annular reference 149 is shown of a similar size as annular reference 148 in FIG. 6*a*, the reference is not so limited. In particular, rotor blades 140*b* and 140*c* may be sized such that annular reference 149 is comparatively smaller or larger than annular reference 148. Additional sets of rotor blades may also be arranged within fluid transfer controller 110. In particular, additional sets of rotor blades may be arranged adjacent to rotor blades 140*c* separated by additional partitions. In such cases, additional intermediate barrier components may be included within fluid transfer controller 110 such that fluid may be successively routed through each of the additional sets of rotor blades. In any case, any one or all intermediate barrier components included within the fluid transfer controllers described herein may include one or more gates in order to bypass sets of rotor blades of the adjacent rotor assembly.

Another distinction between the configurations of fluid transfer controller 110 respectively depicted in FIGS. 6*a* and 7*a* is that rotary shaft 113 is positioned within fluid inlet 130 in FIG. 7*a* and is conversely positioned on the opposing side of hub component 135 in FIG. 6*a*. It is noted, however, that the respective positions of rotary shaft 113 are not restricted to the configurations in which they are depicted. Rather, the variations of the rotary shaft positions are depicted in the two figures to show the alternative positions of rotary shaft 113 for both configurations. As such, rotary shaft 113 may alternatively be positioned within fluid inlet 130 in the configuration depicted in FIG. 6*a*. In addition, rotary shaft 113 may alternatively be positioned on the opposing side of hub component 135 in the configuration of FIG. 7*a*. Furthermore, rotary shaft 13 of fluid transfer controllers 10 depicted in FIGS. 1, 4, and 5 may be alternatively positioned within fluid intake duct 30. As such, although the advantages of both positions are described below in reference to fluid transfer controller 110, the relative power source positions are not necessarily restricted to such configurations.

As shown by comparing FIGS. 6*a* and 7*a*, positioning rotary shaft 113 within fluid inlet 130 may advantageously allow the rotary shaft to be relatively short, particularly with respect to the alternative position on the opposing side of hub component 135. More specifically, positioning rotary shaft 113 within fluid inlet 130 allows rotor bearing 114 to be arranged in closer proximity to rotor assembly 124 than in a position on the opposing side of hub component 135, in effect allowing rotary shaft 113 to be shorter. In contrast, a longer shaft is needed in the configuration depicted in FIG. 6*a* since rotary shaft 113 extends through inlet channel 146 between barrier components 126 and 120 to attach to rotor assembly 124. Such recognition of shaft length variance may be further evident in fluid transfer controllers having multiple levels of rotor blades opposing a fluid inlet, such as shown in FIG. 7*a*. In particular, rotary shaft 113 may be even longer in such embodiments and, therefore, it may be particularly advantageous to position rotary shaft 113 within fluid inlet 130 in such cases.

As noted above, significant costs and maintenance issues are associated with long shafts and, therefore, it may be advantageous in some embodiments to position rotary shaft 113 within fluid inlet 130. In addition, positioning rotary shaft 113 within fluid inlet 130 may offer a manner in which to inherently cool a power source coupled to rotor bearing 114 by the incoming fluid. Furthermore, rotary shaft 113 may be lubricated by a fluid drawn into fluid inlet 130 when positioned therein. In other embodiments, positioning rotary shaft 113 on the side of hub component 135 opposing fluid inlet 130 may be advantageous. In particular, the size of a power source used to rotate shaft 113 may be restricted by the size of fluid inlet 130 in cases in which the power source is positioned therein. Therefore, positioning rotary shaft 113 on the side of hub component 135 opposing fluid inlet 130 may advantageously allow a larger power source to be employed, increasing the range of rpm at which fluid transfer controller 110 may be operated. In addition, positioning rotary shaft 113 within fluid inlet 130 obstructs a portion of the fluid inlet, decreasing the volume of fluid which may be suctioned into fluid transfer controller 110. As such, it may be advantageous to position rotary shaft 113 on the side of hub component 135 opposing fluid inlet 130 to maximize the choking point of fluid transfer controller 110.

Figure 7B:
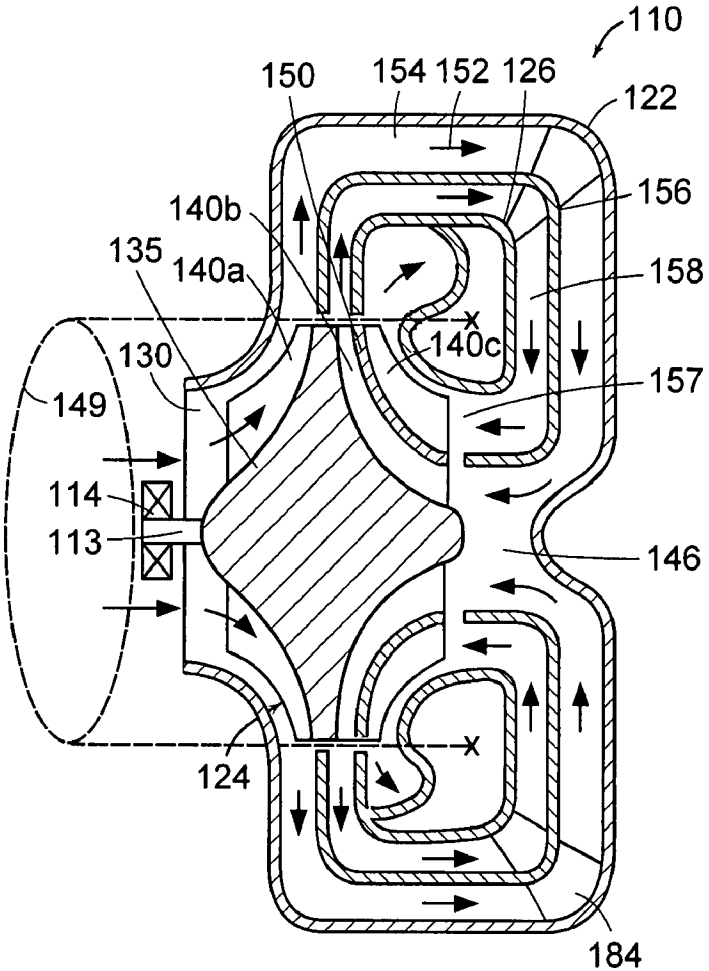
FIG. 7*b* depicts a cross-sectional view of a fluid transfer controller having a similar configuration as FIG. 7*a* with exception of the exterior barrier component having an indentation opposing the fluid inlet.
Figure 6B:
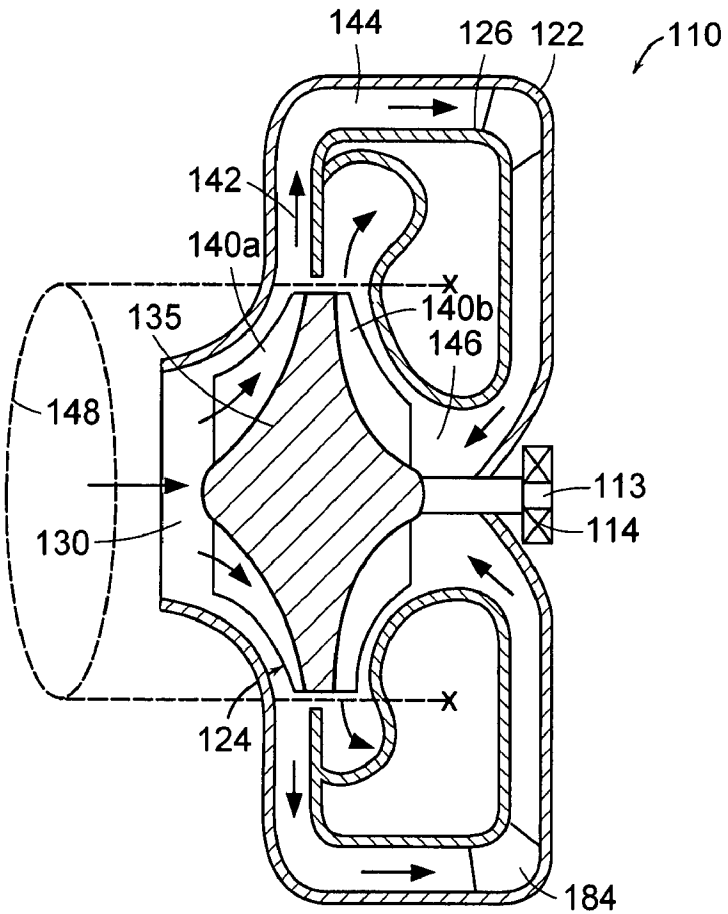
FIG. 6*b* depicts a cross-sectional view of a fluid transfer controller having a similar configuration as FIG. 6*a* with exception of the exterior barrier component having an indentation opposing the fluid inlet.

As noted above, one or more of the components of the fluid transfer controllers described herein may be modified from the depictions in the figures. An exemplary alternative configuration of an outer barrier component for fluid transfer controller 110 is shown and described in reference to FIGS. 6*b* and 7*b*. In particular, FIGS. 6*b* and 7*b* illustrate fluid transfer controller 110 having a similar collection and configuration of components as described in reference to FIGS. 6*a* and 7*a*, respectively, with exception of outer barrier component 122. As shown in FIGS. 6*b* and 7*b*, outer barrier component 122 differs from outer barrier component 120 shown in FIGS. 6*a* and 7*a* by the inclusion of an indentation in the proximity of hub component 135, particularly along the side of hub component 135 opposing fluid inlet 130. The indentation may advantageously aid in guiding fluid into channel 146 and subsequently through rotor blades 140*b*. In particular, the indentation may facilitate a directional change of the fluid to be drawn axially into rotor blades 140*b* as respectively shown in FIGS. 6*b* and 7*b*. In addition, the indentation may allow a shorter rotary shaft to be employed when the shaft is coupled to the side of hub component 135 opposing fluid inlet 130. In particular, as shown by comparing FIG. 6*b* to FIG. 6*a*, rotor bearing 114 may be arranged in closer proximity to rotor assembly 124 than in the configuration depicted in FIG. 6*a*, in effect allowing rotary shaft 113 to be shorter.

Figure 8:
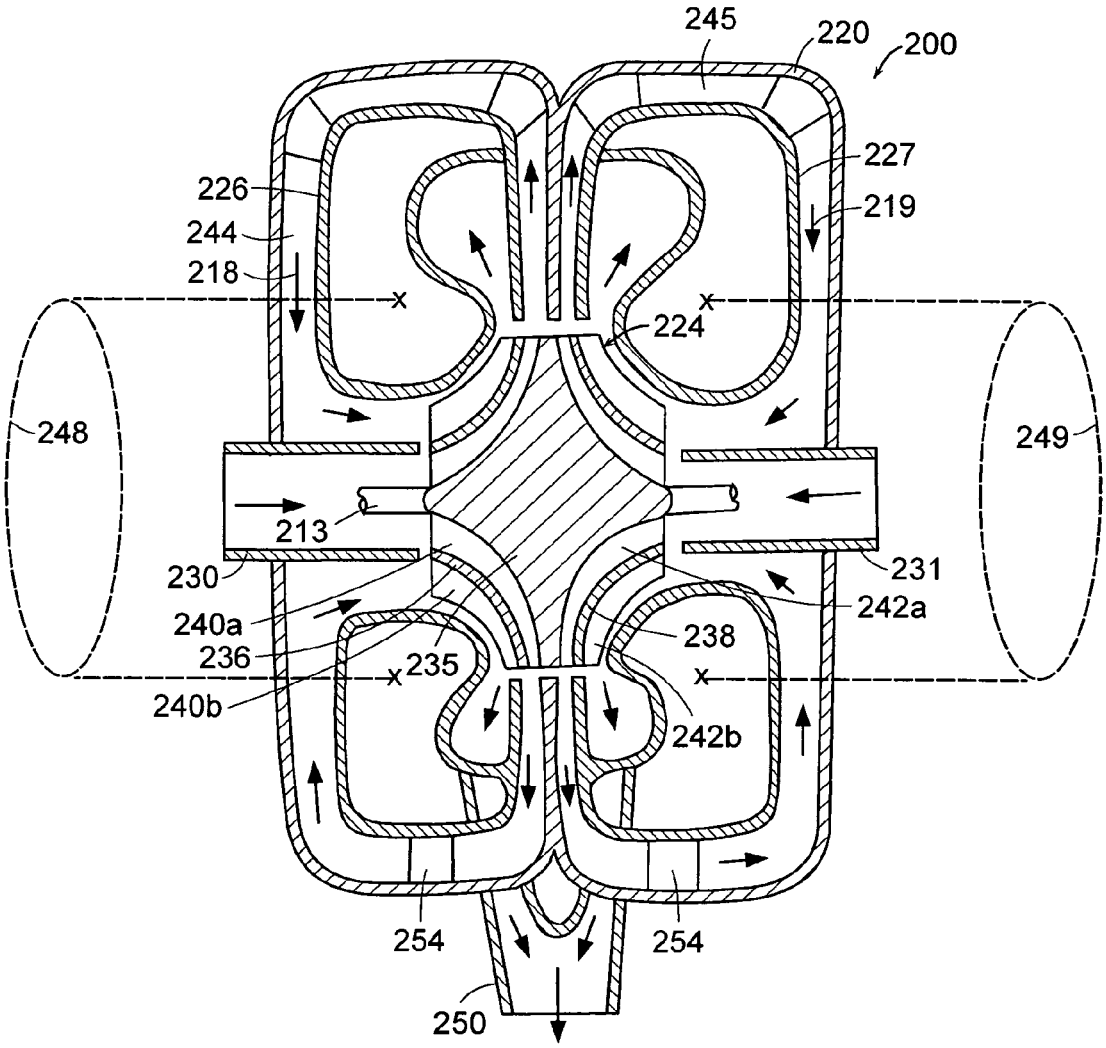
FIG. 8 depicts a cross-sectional view of an exemplary fluid transfer controller having a rotor assembly with multiple levels of rotor blades coupled to opposing sides of a common hub component.
Figure 9:
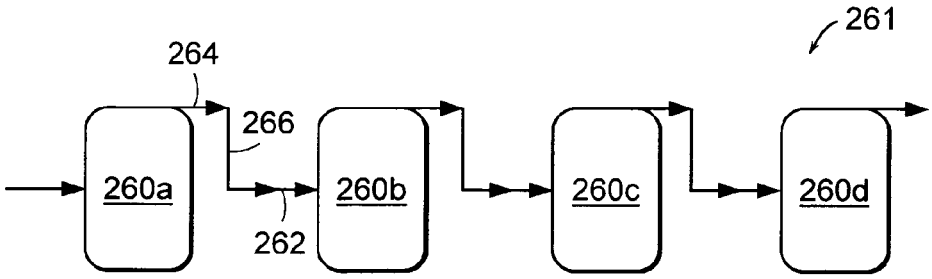
FIG. 9 depicts a schematic drawing of a system having multiple fluid transfer controllers arranged in series, at least one of which includes a configuration selected from those shown in FIGS. 1, 2, and 4-8.

Another configuration of a fluid transfer controller is illustrated in FIG. 8. In particular, FIG. 8 depicts a cross-sectional view of fluid transfer controller 200 having rotor assembly 224 with rotor blade sets 240*a* and 240*b* coupled to opposing sides of partition 236, which are serially stacked upon one side of hub component 235. In addition, rotor assembly 224 includes rotor blade sets 242*a* and 242*b* coupled to opposing sides of partition 238 and serially mounted upon the opposite side of hub component 235. As such, fluid transfer controller 200 includes a rotor assembly having multiple levels of rotor blades upon opposing sides of hub component 235. Fluid transfer controller 200 further includes outer barrier component 220 and inner barrier component 226 configured to form passage 244 for routing fluid in succession through rotor blade sets 240*a* and 240*b*. In addition, fluid transfer controller 200 includes inner barrier component 227 configured with outer barrier component 220 to form passage 245 for routing fluid in succession through rotor blade sets 242*a* and 242*b*. Further yet, fluid transfer controller 200 includes two distinct fluid inlets 230 and 231 arranged in alignment and in proximity to partitions 236 and 238, respectively. Consequently, fluid may be respectively directed into rotor blade sets 240*a* and 242*a*, routed through passages 244 and 245, passed through rotor blade sets 240*b* and 242*b*, collected in respective regions formed by inner barrier components 226 and 227 at the periphery of rotor blades 240*b* and 242*b*, and subsequently dispensed through outlets of fluid transfer controller 200.

In some embodiments, fluid transfer controller 200 may include separate outlets coupled to the collection regions formed by inner barrier components 226 and 227. In other embodiments, however, fluid transfer controller 200 may include a single outlet which merges the fluid streams from the collection regions formed by inner barrier components 226 and 227, such as shown by outlet 250 in FIG. 8. It is noted that the placement of outlet 250 is not necessarily restricted to the position illustrated in FIG. 8. In particular, outlet 250 may alternatively be positioned on the opposing side of fluid transfer controller 200. In other cases, outlet 250 may be positioned along either of the sides of outer barrier component 220 adjacent to fluid inlet duct 230 or 231. Such alternative positions may apply to embodiments in which fluid transfer controller 200 includes multiple outlets as well as for other fluid transfer controllers, such as those described above in reference to FIGS. 1-7. Outlets are not shown in the configurations illustrated in FIGS. 1-7 to simplify the drawings and are to be presumed to be arranged along a portion of the fluid transfer controllers not depicted in the chosen cross-sectional views.

In any case, the resultant fluid flow through fluid transfer controller 200 is two distinct spiral fluid flow routes proceeding away from and toward the rotational axis of rotor assembly 224 as shown by fluid flow arrows 218 and 219 in FIG. 8. More specifically, fluid transfer controller 200 induces two distinct backward spiral fluid flow routes respectively arranged about annular references 248 and 249. As shown in FIG. 8, the approximate positions of annular references 248 and 249 are each denoted by "x"es and are respectively arranged about fluid inlet ducts 230 and 231. Based upon such mirror images of flow and the configuration of its components, fluid flow transfer controller 200 may be described as two back-to-back fluid transfer controllers having configurations similar to that described in reference to FIG. 1. As such, fluid transfer controller 200 may offer a compact manner in which to process distinct fluid streams.

In general, fluid transfer controller 200 may recognize similar benefits as fluid transfer controllers 10 and 110 described in reference to FIGS. 1-7. In particular, fluid transfer controller 200 may realize the benefit of increased fluid velocity and/or pressure generation as compared to conventional fluid transfer controllers of the same size and blade configuration, but only having a single set of rotor blades. In addition, a fluid transfer controller 200 may be more efficient and smaller than a system having conventional fluid transfer controllers arranged in series. Furthermore, the costs associated with fabricating and maintaining fluid transfer controller 200 may be less than a system having conventional fluid transfer controllers arranged in series. A further benefit of fluid transfer controller 200 over a system having conventional fluid transfer controllers arranged in series is lower noise generation. In particular, in addition to providing barriers with which to route fluid into and around rotor assembly 224, casing components 220 and 226 may further dampen noise generated from the rotation of the rotors and the passage of fluid through rotor assembly 224. Although not needed, any or all of such casing components may include a honeycomb interior configuration and/or any noise dampening material to further reduce noise.

As with fluid transfer controllers 10 and 110, fluid transfer controller 200 may include any plurality of sets of rotor blades to successively pass fluid therethrough. In particular, fluid transfer controller 200 may include any number of sets of rotor blades and intervening partitions on both sides of hub component 235. In some embodiments, fluid transfer controller 200 may include the same number of rotor blade sets on opposing sides of hub component 235. In other embodiments, however, fluid transfer controller 200 may include a different quantity of rotor blade sets on opposing sides of hub component 235. In addition, although fluid transfer controller 200 is specifically illustrated having multiple levels on either side of hub component 235, fluid transfer controller 200 may alternatively include a single set of rotor blades on one side of hub component 235. In any case, in accordance with the number of rotor blades sets, fluid transfer controller 200 may include additional barrier components to segregate the fluid flowing successively between the sets of rotor blades.

In general, the shape, size, number, spacing, and direction of rotor blades 240*a*, 240*b*, 242*a* and 242*b* may include any configuration known in the fluid transfer controller industry. In addition, the configuration of rotor blades 240*a*, 240*b*, 242*a* and 242*b* do not necessarily have to be similar. In any case, rotor assembly 224 may include rotary shaft 213 and a rotor bearing coupled thereto (rotor bearings are not illustrated in FIG. 8 to simplify the drawing). In addition, fluid inlet ducts 230 and 231 may protrude from the sidewalls of outer barrier component 220 as shown in FIG. 8 or may be flush with the sidewalls of outer barrier component 220. In some cases, fluid transfer controller 220 may include vanes 254 within passages 244 and/or 245 for guiding fluid flow therethrough. In other embodiments, vanes 254 may be omitted from either or both of passages 244 and/or 245. In any case, outer barrier component 220 may, in some embodiments, include indentations in the proximity of fluid inlet ducts 230 and/or 231 similar to those shown in FIGS. 6*b* and 7*b* for outer barrier component 122 to facilitate a directional change of the fluid to be drawn axially into rotor blades 240*b* and/or 242*b*, respectively.

The clearance between rotor assembly 224 and fluid intake ducts 230 and 231 as well as inner barrier components 226 and 227 may be a sufficient to allow rotor assembly 224 to rotate freely. Moreover, fluid transfer controller 200 may include one or more gates by which to bypass a set of rotor blades. In particular, any of inner barrier components 226 and 227, and/or fluid intake ducts 230 and 231 may include gates similar to gates described for similar components in reference to fluid transfer controllers 10. As noted above, gates permit variability in fluid flow routes leading to variability in the degree to which fluid velocity and/or pressure is increased for a given revolution rate of a rotor assembly. As a consequence, the rotor assembly may be run with fewer changes in revolution rates, placing less stress on the fluid transfer controller while still allowing variable performance by the fluid transfer controller.

FIG. 9 illustrates an exemplary schematic diagram of a system including a plurality of fluid transfer controllers arranged in series. More specifically, FIG. 9 illustrates system 261 having fluid transfer controllers 260*a*-260*d* successively connected by intervening conduits. As shown between fluid transfer controllers 260*a* and 260*b*, conduit 266 may connect outlet 264 of one fluid transfer controller to inlet 262 of another fluid transfer controller. A similar connection is made between fluid transfer controllers 260*b* and 260*c* as well as between fluid transfer controllers 260*c* and 260*d*. Although connecting neighboring fluid transfer controllers, as shown in FIG. 9, may be advantageous for minimizing the intricacy of conduits 266, system 261 is not necessarily so restricted. In particular, conduits 266 may be used to connect outlets and inlets of any of fluid transfer controllers 260*a*-260*d*. In addition, although system 261 is shown including four fluid transfer controllers, the system is not necessarily so restricted. In particular, system 261 may include any plurality of fluid transfer controllers.

In general, at least one of fluid transfer controllers 260*a*-260*d* includes a configuration described in reference to FIGS. 1, 2, and 4-8. In particular, at least one of fluid transfer controllers 260*a*-260*d* includes a rotor assembly having multiple sets of rotor blades coupled to opposing sides of a dividing structure, the dividing structure being either a partition or a hub component of the rotor assembly. In addition, at least one fluid transfer controller includes barrier components configured to form passages which allow fluid to be routed through a first set of rotor blades and subsequently through a second set of rotor blades. More specifically, at least one fluid transfer controller includes barrier components configured to form a spiral fluid flow passage for routing fluid successively through the rotor blade sets.

In cases in which a plurality of fluid transfer controllers 260*a*-260*d* include a rotor assembly and barrier components of such configurations, the controllers may include the same or different designs. Alternatively stated, the arrangement of rotor blade sets and barrier components among a plurality of fluid transfer controllers 260*a*-260*d* may be the same or different pertaining to the configurations described in reference to FIGS. 1, 2, and 4-8. In some embodiments, all of fluid transfer controllers 260*a*-260*d* may include a configuration described in reference to FIGS. 1, 2, and 4-8. In other cases, however, less than all of fluid transfer controllers 260*a*-260*d* may include a configuration described in reference to FIGS. 1, 2, and 4-8. As such, system 261 is not restricted from including fluid transfer controllers of conventional configurations (e.g., having only a single rotor blade set coupled to a hub component of a rotor assembly).

As noted above, the fluid transfer controllers described in reference to FIGS. 1-8 may generally be used as compressors, pumps, blowers, or turbochargers. The concept of using multiple sets of rotors and barrier components for routing fluid successively therethrough, however, is not necessarily limited to such applications. In particular, the concepts may be applied to other types of fluid transfer controllers, such as turbo-engines, for example. As noted above, a turbo-engine refers to a fluid transfer controller having a compressor and a turbine each characterized by one or more sets of rotor blades and configured for coupling to a thermal energy alteration device. Exemplary configurations of turbo-engines having rotor assemblies and barrier components similar to the configurations described in reference to FIGS. 1-8 are shown in FIGS. 10-14.

Figure 10:
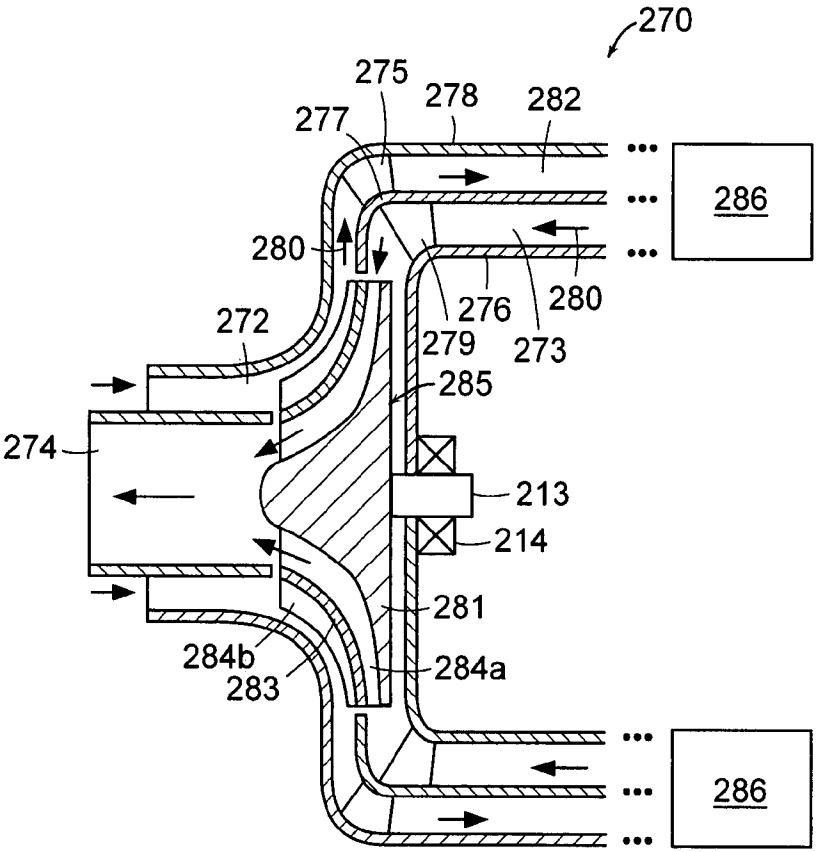
FIG. 10 depicts a cross-sectional view of an exemplary turbo-engine system including a fluid transfer controller configured for coupling to a thermal energy alteration device.

In particular, FIG. 10 illustrates an exemplary cross-sectional view of fluid transfer controller 270 configured to function as a turbo-engine having a compressor and turbine integrated together therein. As shown in FIG. 10, fluid transfer controller 270 includes fluid outlet 274 nested within fluid inlet 272. As will be described in more detail below, such a configuration is in accordance with the direction of fluid flow through fluid transfer controller 270 as denoted by arrows 280. In some embodiments, however, fluid may be routed in the opposite direction through fluid flow transfer controller 270 and, consequently, components 272 and 274 may serve as an outlet and an inlet, respectively. In addition, it is noted that fluid inlet 272 and fluid outlet 274 may be oriented in different manners than that shown in FIG. 10. In particular, the end of fluid inlet 272 may be configured to flare out away from the outlet of fluid outlet 274. In this way, the exhaust from fluid transfer controller 270 may be more distinctly segregated from the inlet stream of the controller. In other embodiments, it may be advantageous to introduce a small amount of exhaust into the inlet stream, and, therefore, the barrier component of fluid outlet 274 may, in some embodiments, include one or more gates, similar to gates 66 described in reference to FIG. 5.

In any case, fluid transfer controller 270 includes a rotor assembly having multiple levels of rotor blades coupled to a hub component and, in some embodiments, a rotor assembly having a configuration similar to rotor assembly 24 described in reference to FIG. 1. More specifically, fluid transfer controller 270 includes rotor assembly 285 with rotor blade set 284*a*, partition 283, and rotor blade set 284*b* serially stacked upon hub component 281. Furthermore, rotor assembly 287 includes rotary shaft 213 and bearing 214 coupled to hub component 281. In addition to rotor assembly 285, fluid transfer controller 270 includes barrier components 276, 277, and 278 configured to form a set of passages segregated by a common wall and respectively adapted to route fluid from rotor blade set 284*b* to thermal energy alteration device 286 and further route fluid from thermal energy alteration device 286 to rotor blade set 284*a*. In particular, barrier component 277 may be arranged proximate to the periphery of partition 283 and interposed between barrier components 276 and 278 to form a common wall between passages 282 and 273 which respectively lead toward and away from thermal energy alteration device 286.

As shown in FIG. 10, continuation dots extend from barrier components 276, 277, and 278, denoting their adaptation for attachment with thermal energy alteration device 286. As such, fluid transfer controller 270 may be configured for coupling to thermal energy alteration device 286. In some cases, fluid transfer controller 270 may be representative of a device having thermal energy alteration device 286 attached thereto, either fixedly adjoined or detachably connected. In other embodiments, fluid transfer controller 270 may be representative of a device which does not include thermal energy alteration device 286, but rather is configured for subsequent connection thereto. In either case, thermal energy alteration device 286 may generally refer to any device configured to alter the thermal energy of a fluid. In some embodiments, thermal energy alteration device 286 may specifically be configured to increase the thermal energy of a fluid and as such, may alternatively be referred to as a thermal energy enrichment device. Exemplary devices for thermal energy alteration device 286 may include but are not limited to a combustion chamber, a boiler, a heat exchanger, or a nuclear reactor. In embodiments in which thermal energy alteration device 286 is a combustion chamber, fluid transfer controller 270 may be configured for coupling to annular combustor or a can combustor. Although FIG. 10 illustrates fluid transfer controller 270 including/coupled to two thermal energy alteration devices, the system is not necessarily so limited. In particular, fluid transfer controller 270 may be configured for coupling to any number of thermal energy alteration devices, including a single device or a plurality of devices. In some embodiments, the two boxes in FIG. 10 denoted with reference number 286 may represent an annular configuration of a thermal energy alteration device and, as such, may represent a single device.

As shown by fluid flow arrows 280, fluid may be introduced into fluid inlet 272, the passage of which leads to rotor blades 284*b* and is substantially blocked from rotor blades 284*a* by the inclusion of fluid outlet duct 274 within fluid inlet 272. Rotor blades 284*b* are radially arranged against partition 283 and, thus, may transfer the fluid in a centrifugal motion toward passage 282 and eventually to thermal energy alteration device 286 coupled thereto. More specifically rotor blades 284*b* may be configured to increase the pressure of fluid routed therethrough and, therefore, may serve as a compressor. As shown in FIG. 10, barrier components 277 and/or 278 may include vanes 275 coupled to their interior surfaces to lessen the swirling motion of fluid exiting rotor blades 284*b*. In other embodiments, however, vanes 275 may be omitted from fluid transfer controller 270.

Fluid dispensed from the thermal energy alteration device 286 may be routed through passage 273, which is separated from passage 282 by barrier component (or common wall) 277. In some embodiments, barrier components 276 and/or 277 may include vanes 279 coupled to their interior surfaces as shown in FIG. 10. In other embodiments, however, vanes 279 may be omitted from fluid transfer controller 270. From passage 273, fluid is routed through rotor blade set 284*a*, which is interposed between partition 283 and hub component 281. The rotation of rotor blades 284*a* may serve as a turbine to convert the thermal energy of the fluid dispensed from thermal energy alteration device 286 into mechanical energy. It is noted that the adaptations of rotor blades 284*a* and 284*b* may be reversed when the fluid flow route 280 is reversed through fluid transfer controller 270. Furthermore, although FIG. 10 illustrates fluid transfer controller 270 having only one set of rotor blades configured to function as a compressor and only one set rotor blades configured to function as a turbine, fluid transfer controller 270 may include multiple sets of rotor blades for either one or both of such functions. An exemplary configuration of a turbo-engine having multiple levels of rotor blades, two of which are configured to function as a compressor and another which is configured to function as a turbine is shown in FIG. 11.

Figure 11:
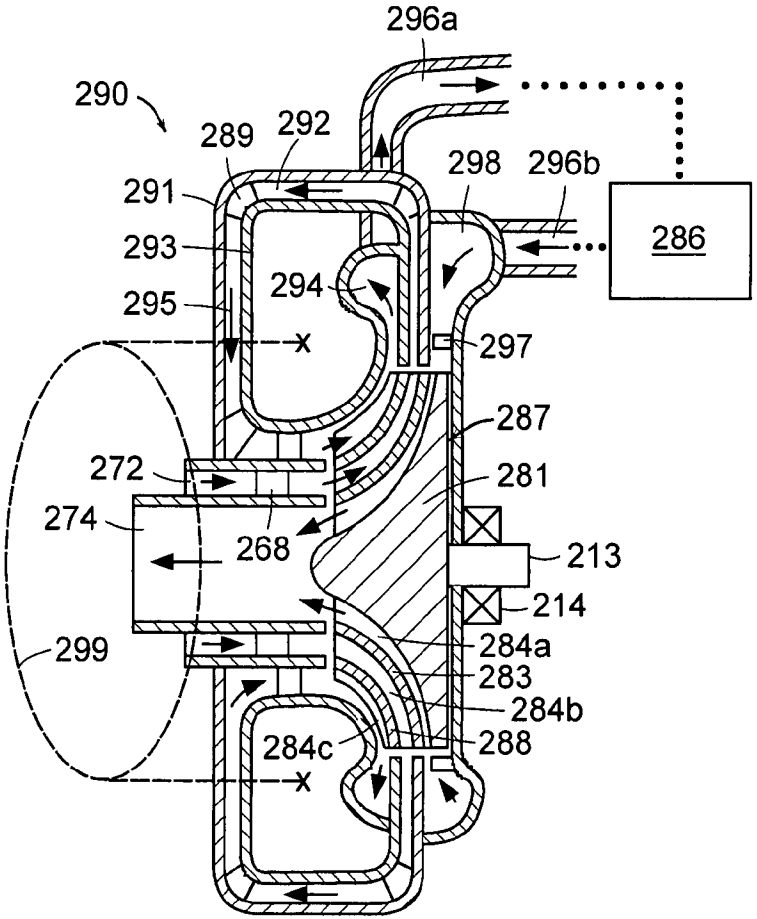
FIG. 11 depicts a cross-sectional view of an exemplary turbo-engine system having a different configuration of a fluid transfer controller configured for coupling to a thermal energy alteration device.

In particular, FIG. 11 illustrates fluid transfer controller 290 including rotor assembly 287 with rotor blade set 284*a*, partition 283, rotor blade set 284*b*, partition 288, and rotor blade set 284*c* serially stacked upon hub component 281. In addition, rotor assembly 287 includes rotary shaft 213 and bearing 214 coupled to hub component 281. Such a rotor assembly configuration is similar to the configuration of rotor assembly 24 described above in reference to FIG. 4. In addition, fluid transfer controller 290 includes a plurality of barrier components and conduits for routing fluid through the multiple sets of rotor blades as shown by fluid route arrows 295. In particular, fluid transfer controller 290 includes fluid inlet duct 272 aligned in proximity to partition 288 for drawing fluid into rotor blade set 284*b*. Furthermore, fluid transfer controller 290 includes outer barrier component 291 and inner barrier component 293 which collectively form passage 292 for routing fluid from the periphery of rotor blade set 284*b* to an inlet channel leading to rotor blade set 284*c*, the inlet channel being formed by inner barrier component 293 and the exterior surface of fluid inlet duct 272.

In some embodiments, passage 292 and/or fluid inlet 272 may respectively include vanes 289 and 268 to guide fluid therethrough, as shown in FIG. 11. The inclusion of vanes 268 and 289, however, are optional and, therefore, may be omitted in some embodiments. In any case, inner barrier component 293 further forms collector region 294 at the periphery of rotor blade set 284*c* to collect the fluid routed through rotor blade set 284*c*. As shown in FIG. 11, the assembly of the aforementioned components forms a spiral fluid flow route about annular reference 299 which is spaced about a rotational axis of hub component 281. The rotational movement of rotor assembly 287 serves to increase the pressure of fluid routed through rotor blade sets 284*b* and 284*c* and, therefore, the assembly of aforementioned components may serve as a compressor.

As shown in FIG. 11, fluid transfer controller 290 further includes conduits 296*a* and 296*b* leading toward and from thermal energy alteration device 286, respectively. As with fluid transfer controller 270 described in reference to FIG. 10, fluid transfer controller 290 may be configured for coupling to thermal energy alteration device 286 as indicated by the continuation dots in FIG. 11. In addition, fluid transfer controller 290 may include or may be coupled to any number of thermal energy alteration devices and, therefore, is not limited to a single thermal energy alteration device as shown in FIG. 11. Coupled to conduit 296*b*, fluid transfer controller 290 includes volute 298 for routing fluid to rotor blade set 284*a*. As shown in FIG. 11, fluid transfer controller 290 may include vanes 297 for distributing the fluid to the periphery of rotor blade set 284*a*. Inset within fluid inlet duct 272, fluid transfer controller 290 includes fluid outlet duct 274 for dispensing fluid from the controller subsequent to passing through rotor blade set 284*a*. The rotation of rotor blades 284*a* may serve as a turbine to convert the thermal energy of the fluid dispensed from thermal energy alteration device 286 into mechanical energy.

An alternative configuration of a turbo-engine having a compressor and a turbine each characterized by one or more sets of rotor blades is shown in FIG. 12. In particular, FIG. 12 illustrates fluid transfer controller 300 including rotor assembly 321 having rotor blade sets 320*a* and 320*b* on opposing sides of hub component 322. In addition, rotor assembly 321 includes rotary shaft 313 and a rotor bearing coupled thereto (a rotor bearing is not illustrated in FIG. 12 to simplify the drawing). Such a rotor assembly configuration is similar to the configuration of rotor assembly 124 described above in reference to FIG. 6*a*. It is noted that rotary shaft 313 may be positioned on either side of hub component 322 and, therefore, is not necessarily limited to the arrangement depicted in FIG. 12.

Fluid transfer controller 300 includes barrier components 314, 316, and 318 configured to form a set of passages segregated by a common wall and respectively adapted to route fluid from rotor blade set 320*a* to thermal energy alteration device 286 and further route fluid from thermal energy alteration device 286 to rotor blade set 320*b*. In particular, barrier component 316 may be arranged proximate to the periphery of hub component 322 and interposed between barrier components 314 and 318 to form a common wall between passages 306 and 310 which respectively lead toward and away from thermal energy alteration device 286. In addition, barrier component 314 may be configured to form inlet 302 and barrier component 318 may be configured to form outlet 312. In some cases, barrier components 314 and 318 may protrude from the sidewalls of fluid transfer controller 300 to form inlet 302 and outlet 312, respectively, as shown in FIG. 12. In other embodiments, however, inlet 302 and/or outlet 312 may be flush with the sidewalls of fluid transfer controller 300. In either case, continuation dots are included within FIG. 12 between barrier components 314, 316, and 318 and thermal energy alteration device 286, denoting their adaptation for attachment with thermal energy alteration device 286. As with fluid transfer controller 270 described in reference to FIG. 10, although FIG. 12 illustrates fluid transfer controller 300 including/coupled to two thermal energy alteration devices, the system is not necessarily so limited.

As shown by fluid flow route arrows 304, fluid may be introduced into fluid inlet 302, the passage of which leads to rotor blades 320*a*. Rotor blades 320*a* are radially arranged against partition hub component 322 and, thus, may transfer the fluid in a centrifugal motion toward passage 306 and eventually to thermal energy alteration device 286 coupled thereto. More specifically rotor blades 320*a* may be configured to increase the pressure of fluid routed therethrough and, therefore, may serve as a compressor. Although not shown, barrier components 314 and/or 316 may include vanes coupled to their interior surfaces to lessen the swirling motion of fluid exiting rotor blades 320*a*. Fluid dispensed from the thermal energy alteration device 286 may be routed through passage 310, which is separated from passage 306 by barrier component (or common wall) 316. From passage 310, fluid is routed through rotor blade set 320*b*, which is arranged on the side of hub component 322 opposing rotor blades 320*a*. The rotation of rotor blades 320*b* may serve as a turbine to convert the thermal energy of the fluid dispensed from thermal energy alteration device 286 into mechanical energy.

It is noted that the adaptations of rotor blades 320*a* and 320*b* may be reversed when the fluid flow route 304 is reversed through fluid transfer controller 300. Furthermore, although FIG. 12 illustrates fluid transfer controller 300 having only one set of rotor blades configured to function as a compressor and only one set rotor blades configured to function as a turbine, fluid transfer controller 300 may include multiple sets of rotor blades for either one or both of such functions. An exemplary configuration of a turbo-engine having multiple levels of rotor blades, two of which are configured to function as a compressor and another which is configured to function as a turbine is shown in FIG. 13 and described in more detail below.

Figure 13:
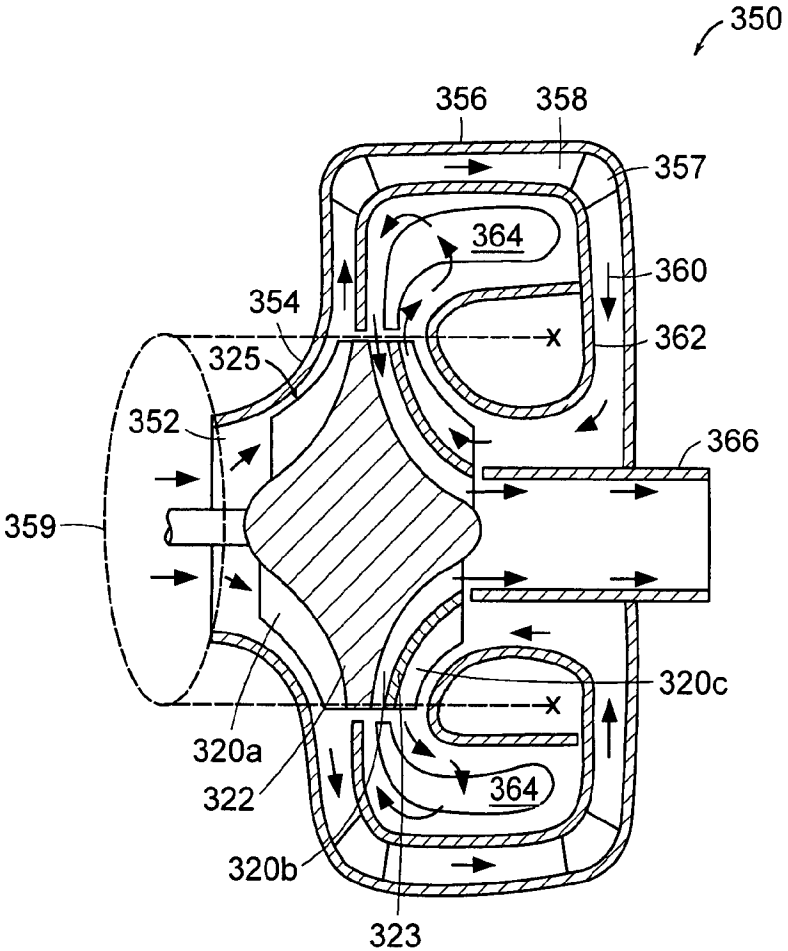
FIG. 13 depicts a cross-sectional view of an exemplary turbo-engine system having a fluid transfer controller with a thermal energy alteration device incorporated therein.

In particular, FIG. 13 illustrates fluid transfer controller 350 having rotor assembly 325 with rotor blades 320*a* arranged on one side of hub component 322 proximate to fluid inlet 352 and rotor blades 320*b*, partition 323, and rotor blades 320*c* successively mounted upon an opposite side of hub component 322. Such a rotor assembly configuration is similar to the configuration of rotor assembly 124 described in reference to FIG. 7*a*. Fluid transfer controller 350 further includes outer barrier component 356 and inner barrier component 362, which collectively form passage 358 for routing fluid from the periphery of rotor blade set 320*a* to an inlet channel leading to rotor blade set 320*c* formed by inner barrier component 362 and the exterior surface of fluid outlet duct 366. As shown in FIG. 13, passage 358 may include vanes 357 to guide fluid therethrough and lessen the swirling motion of fluid exiting rotor blades 320*a*. The inclusion of vanes 357, however, is optional and, therefore, vanes 357 may be omitted in some embodiments.

As further shown in FIG. 13, the assembly of the components within fluid transfer controller 350 forms a spiral fluid flow route about annular reference 359 which is spaced about a rotational axis of hub component 322. The rotational movement of rotor assembly 325 serves to increase the pressure of a fluid routed through rotor blade sets 320*a* and 320*c* and, therefore, the collection of such components may serve as a compressor. In some embodiments, outer barrier component 356 may include indentations in the proximity of fluid outlet duct 366 similar to those shown in FIGS. 6*b* and 7*b* for outer barrier component 122 to facilitate a directional change of the fluid to be drawn axially into rotor blades 320*c*.

In addition to barrier components 356 and 362 and fluid outlet duct 366, fluid transfer controller 350 may include thermal energy alteration device 364 incorporated within the confines of inner barrier component 362 at the periphery of rotor blade sets 320*b* and 320*c*. As with thermal energy alteration device 286 described in reference to FIG. 10, thermal energy alteration device 364 may include any device configured to alter the thermal energy of a fluid, such as but not limited to a combustion chamber, a boiler, a heat exchanger, or a nuclear reactor. In embodiments in which thermal energy alteration device 364 includes a combustion chamber, a fuel line may be inserted within the thermal energy alteration device. As shown in FIG. 13, fluid is radially routed through rotor blades 320*c*, passes through thermal energy alteration device 364, is subsequently routed through rotor blades 320*b*, and finally dispensed through outlet 366. The rotation of rotor blades 320*b* may serve as a turbine to convert the thermal energy of the fluid dispensed from thermal energy alteration device 364 into mechanical energy.

It is noted that the incorporation of thermal energy alteration device 364 within fluid transfer controller 350 is not necessarily mutually exclusive with the configuration of rotor assembly 325. In particular, fluid transfer controller 350 may be alternatively configured with channels respectively coupled in proximity to the periphery of rotor blades 320*c* and 320*b* for routing fluid toward and away from thermal energy alteration device coupled thereto similar to the configurations described in reference to FIGS. 10-12. Likewise, the fluid transfer controllers described in reference to FIGS. 10-12 may alternatively have thermal energy alteration devices incorporated within their respective barrier components.

Figure 14:
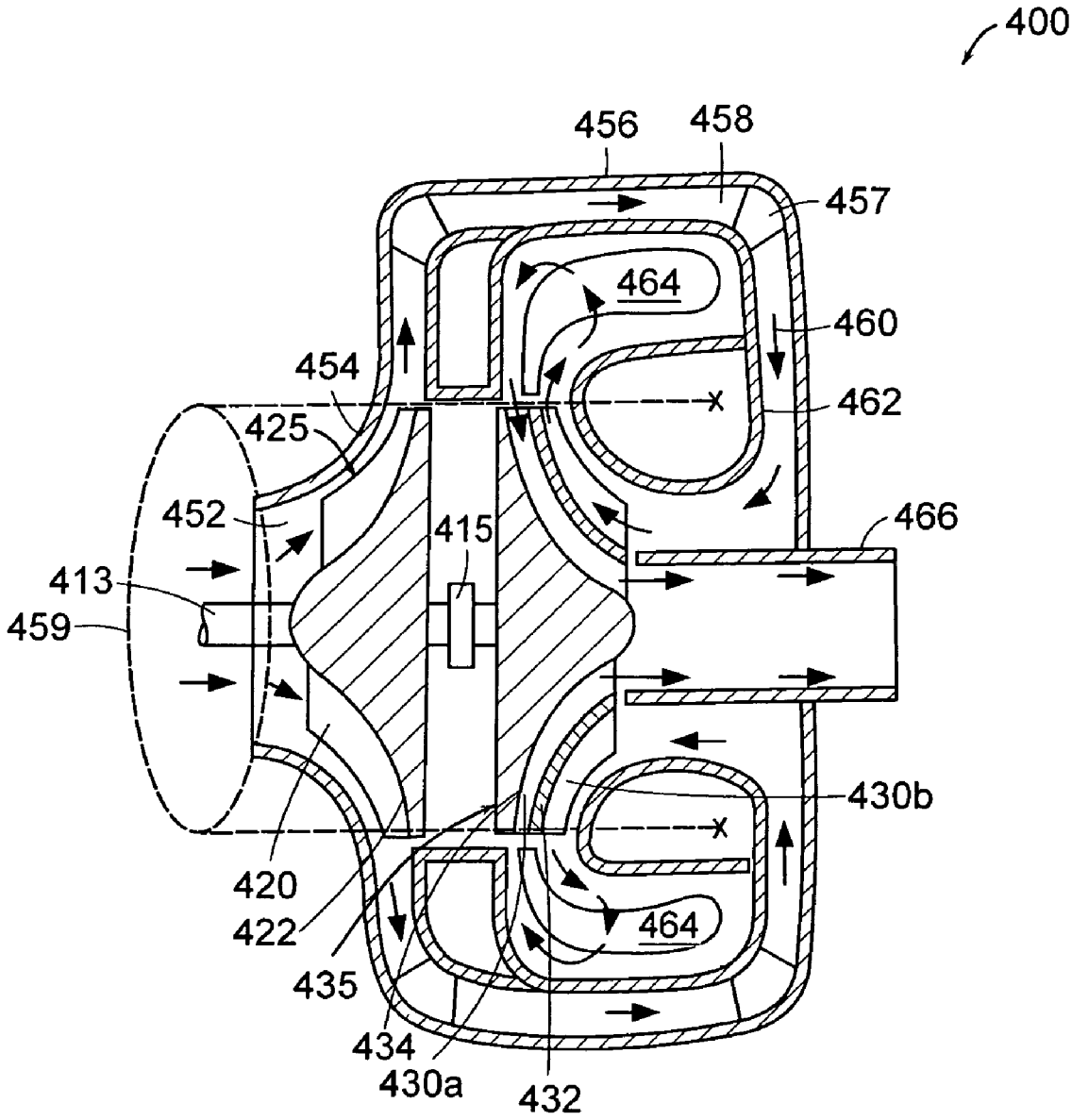
FIG. 14 depicts a cross-sectional view of another exemplary turbo-engine system having a fluid transfer controller with a thermal energy alteration device incorporated therein.

Furthermore, the fluid transfer controllers described herein are not necessarily limited to having only one rotor assembly arranged within the confines of the controllers' barrier components. In particular, any one of the fluid transfer controllers described in reference to FIGS. 1-13 may include one or more additional rotor assemblies. One or more of the additional rotor assemblies may include multiple sets or multiple levels of rotor blades, including any of the configurations described in reference to FIGS. 1-13. In addition or alternatively, one or more of the additional rotor assemblies may include a single set of rotor blades. An exemplary embodiment of a fluid transfer controller having multiple rotor assemblies arranged within the confines of barrier components of the controller is shown and described in reference to FIG. 14. In particular, FIG. 14 illustrates fluid transfer controller 400 including rotor assemblies 425 and 435 arranged within outer barrier component 456. As shown in FIG. 14, rotor assembly 425 includes a single set of rotor blades 420 coupled to hub component 422 proximate to fluid inlet 452. In addition, rotor assembly 435 includes rotor blades 430*a*, partition 432, and rotor blades 430*b* serially stacked upon hub component 434. The relative connection of rotor assemblies 425 and 435 along shaft 413 as well as other possible configurations are described in more detail below following a description of the other components of fluid transfer controller 400 and its overall operation.

As further shown in FIG. 14, fluid transfer controller 400 may include outer barrier component 456 and inner barrier component 462, which collectively form passage 458 for routing fluid from the periphery of rotor blade set 420 to an inlet channel leading to rotor blade set 430*b* formed by inner barrier component 462 and the exterior surface of fluid outlet duct 466. In some cases, passage 458 may include vanes 457 to guide fluid therethrough and lessen the swirling motion of fluid exiting rotor blades 420. The inclusion of vanes 457, however, is optional and, therefore, vanes 457 may be omitted in some embodiments. In some cases, outer barrier component 456 may additionally or alternatively include indentations in the proximity of fluid outlet duct 466 similar to those shown in FIGS. 6*b* and 7*b* for outer barrier component 122 to facilitate a directional change of the fluid to be drawn axially into rotor blades 430*b*. In any case, as shown in FIG. 14, the assembly of the components within fluid transfer controller 400 forms a spiral fluid flow route about annular reference 459 which is spaced about a rotational axis of rotor assemblies 425 and 435. The rotational movement of rotor assemblies 425 and 435 serve to increase the pressure of a fluid routed through rotor blade sets 420 and 430*b* and, therefore, the collection of such components may serve as a compressor.

As shown in FIG. 14, fluid passes from rotor blades 430*b* through thermal energy alteration device 464, which is incorporated within the confines of inner barrier component 462 at the periphery of rotor blade sets 430*a* and 430*b*. Similar to thermal energy alteration device 364 described in reference to FIG. 13, thermal energy alteration device 464 may include any device configured to alter the thermal energy of a fluid, such as but not limited to a combustion chamber, a boiler, a heat exchanger, or a nuclear reactor. In addition, in embodiments in which thermal energy alteration device 464 includes a combustion chamber, a fuel line may be inserted within the thermal energy alteration device. Subsequent to passing through thermal energy alteration device 464, fluid is routed through rotor blades 430*a* and finally dispensed through outlet 466. The rotation of rotor blades 430*a* may serve as a turbine to convert the thermal energy of the fluid dispensed from thermal energy alteration device 464 into mechanical energy.

FIG. 14 shows rotor assemblies 425 and 435 each connected to rotary shaft 413 such that rotational motion may be provided to both. In alternative embodiments, rotor assemblies 425 and 435 may be coupled to separate shafts. In particular, shaft 413 may be coupled to rotor assembly 425 and a different shaft may be coupled to rotor assembly 435. The shaft coupled to rotor assembly 435 may either be coupled to the apex of hub component 434 through fluid outlet duct 466 or may be arranged within the interior of shaft 413. A shaft coupled to the apex of hub component 434 may be exclusive to rotor assembly 435 or, alternatively, may be further coupled to rotor assemblies of other fluid transfer controllers. In any case, separate shafts may allow rotor assemblies 425 and 435 to be rotated independently of each other and, in some cases, rotated at different speeds and/or at different times relative to each other.

A variance of speed and rotational independence, however, may also be incorporated with a single shaft having a clutch interposed between the rotor assemblies, such as illustrated in FIG. 14 by shaft 413 and clutch 415 and described in more detail below. In yet other embodiments, distinct shafts of rotor assemblies 425 and 435 may be joined by a clutch which is configured to disengage at a certain rpm and/or a choking point of one of the rotor assemblies. It is noted that although the inclusion of clutch 415 and/or separate shafts within fluid transfer controller 400 may be beneficial for many reasons, clutch 415 and/or separate shafts for rotor assemblies 425 and 435 are not necessarily needed for the operation fluid transfer controller 400. Consequently, clutch 415 and/or the concept of separate shafts for rotor assemblies 425 and 435 may be omitted from fluid transfer controller 400 in some embodiments.

In some embodiments, varying the speed at which rotor assemblies 425 and 435 are rotated with respect to each other may be advantageous. For instance, it may be advantageous to run a turbine at relatively fast speeds in order to maximize the conversion of thermal energy into mechanical energy. In contrast, running a compressor at such speeds may exceed its choking point and, thus, the compressor may be unnecessarily operated at an elevated revolution rate. As described above, the rotation of rotor blades 430*a* may serve as a turbine and the collective rotation of rotor blades 420 and 430*b* may serve as a compressor. As such, varying the relative speeds of rotor assemblies 425 and 435 may offer a manner in which to optimize the operations of the resultant turbine and compressor.

In addition to varying the speeds of rotor assemblies 425 and 435, varying the times at which the rotor assemblies are rotated may offer a benefit of reducing the relative power requirements to run fluid transfer controller 400. In particular, fluid transfer controller 400 may be configured to allow rotor assembly 425 to start rotating while inhibiting the rotation of rotor assembly 435 until fluid flow generated from thermal energy device 464 is sufficient to cause rotation of rotor assembly 435. Such a configuration may be particularly applicable for a start-up phase of fluid transfer controller 400, but is not necessarily so restricted. Among the advantages of this approach is that the energy needed to start the rotation of rotor assembly 425 may be less than the energy needed to rotate both of rotor assemblies 425 and 435. An exemplary description of varying the time at which rotor assemblies 425 and 435 are rotated when fluid transfer controller 400 includes clutch 415 along shaft 413 as shown in FIG. 14 is provided below. It is noted, however, that similar timings of rotation may be incorporated by other configurations of clutches and/or separate shafts coupled to rotor assemblies 425 and 435 and, therefore, the operation of fluid flow controller 400 is not necessarily so limited.

Using the configuration of fluid flow controller 400 in FIG. 14, fluid compressed by the rotation of rotor assembly 425 may be directed through passage 458 and rotor blades 430*b* (without rotation thereof) to thermal energy alteration device 464. Fluid with increased thermal energy may be expelled from thermal energy alteration device 464, causing rotor assembly 435 to be propelled. In addition, the high thermal energy fluid may cause clutch 415 to engage. In general, many types of clutch mechanisms may be used. When clutch 415 is engaged, the power generated by the turbine of fluid transfer controller 400 may be sufficient to drive rotor assembly 425 as well as rotor assembly 435.

It will be appreciated by those skilled in the art having the benefit of this disclosure that this invention is believed to provide fluid transfer controllers having a rotor assembly with multiple sets of rotor blades coupled to a common hub component of the rotor assembly. The fluid transfer controllers further include barrier components configured to form passages for routing fluid through the multiple sets of rotor blades in a compact manner. Further modifications and alternative embodiments of various aspects of the invention will be apparent to those skilled in the art in view of this description. For example, various combinations of the rotor assemblies and barrier components described herein may be used to fabricate alternate designs of fluid transfer controllers having the core concept of multiple sets of rotor blades arranged about the same hub component and in proximity to each other. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A fluid transfer controller, comprising:

a rotor assembly comprising a hub component and multiple levels of rotor blades coupled by one or more intervening partitions, wherein the multiple levels of rotor blades and one or more intervening partitions are serially stacked upon the hub component; and barrier components configured to form passages for routing fluid among different levels of rotor blades of the multiple levels of rotor blades, wherein the barrier components comprise one or more gates to allow fluid to bypass at least one of the multiple levels of rotor blades.

2. The fluid transfer controller of claim 1, wherein the barrier components are configured to form passages for successively routing fluid among neighboring levels of rotor blades of the multiple levels of rotor blades.

3. The fluid transfer controller of claim 1, wherein at least one of the multiple levels of rotor blades is configured to change the state of the fluid.

4. The fluid transfer controller of claim 1, further comprising a storage medium comprising program instructions executable by a processor for opening and closing the one or more gates depending on operational criteria set for the fluid transfer controller.

5. The fluid transfer controller of claim 1, further comprising a fluid intake duct substantially aligned and proximate to one of the intervening partitions such that incoming fluid is primarily routed through a first level of rotor blades directly coupled to the hub component.

6. The fluid transfer controller of claim 5, wherein the fluid intake duct comprises one or more gates to allow fluid to bypass the first set of rotor blades to a neighboring set of rotor blades.

7. The fluid transfer controller of claim 6, further comprising a storage medium comprising program instructions executable by a processor for independently opening and closing the one or more gates comprising the baffler components and the one or more gates comprising the fluid intake duct depending on operational criteria set for the fluid transfer controller.

8. The fluid transfer controller of claim 1, wherein the rotor assembly further comprises a single level of rotor blades coupled to a side of the hub component opposing the multiple levels of rotor blades, and wherein the barrier components are configured to form a fluid intake to route incoming fluid through the single level of rotor blades to the passages for routing fluid through the multiple levels of the rotor blades.

9. The fluid transfer controller of claim 8, further comprising a rotary shaft coupled to the side of the hub component comprising the single level of rotor blades.

10. The fluid transfer controller of claim 1, wherein the rotor assembly further comprises more than one level of rotor blades and one or more adjoining partitions successively stacked upon a side of the hub component opposing the multiple levels of rotor blades, and wherein the barrier components are configured to form other passages for routing fluid through the one or more levels of rotor blades.

11. The fluid transfer controller of claim 10, further comprising two distinct fluid intake ducts respectively configured to route incoming fluid through base levels of rotor blades directly coupled to opposing sides of the hub component.

12. A turbo-engine system, comprising:

a rotor assembly comprising;

a hub component assembly;

a first set of rotor blades coupled to a first side of the hub component assembly; and second and third sets of rotor blades serially mounted to a second side of the hub component assembly opposing the first side of the hub component assembly, wherein the second and third sets of rotor blades are separated by an intervening partition;

a fluid inlet substantially aligned and proximate to the first set of rotor blades such that incoming fluid is primarily routed through the first set of rotor blades;

barrier components configured to form a forward spiraled fluid flow route from the first set of rotor blades to the third set of rotor blades about an annular reference spaced about a rotational axis of the hub component assembly, wherein the first and third sets of rotor blades are configured to compress fluid routed therethrough; and a thermal energy enrichment device disposed within the barrier components and along peripheries of the second and third sets of rotor blades such that:

fluid from the third set of rotor blades is routed into the thermal energy enrichment device; and exhaust fluid from the thermal energy enrichment device is routed to the second set of rotor blades, wherein the second set of rotor blades is configured to convert thermal energy of the exhaust fluid into mechanical energy.

13. The system of claim 12, wherein the barrier components comprise an outer barrier component having an indentation arranged along the second side of the hub component assembly approximately centered along the rotational axis of the hub component assembly and in proximity to the fluid outlet.

14. The system of claim 13, wherein the rotor assembly comprises a rotary shaft extending from the hub component assembly through the indentation of the outer barrier component.

15. The system of claim 12, wherein the rotor assembly comprises a rotary shaft extending from the hub component assembly through the fluid inlet.

16. The system of claim 12, wherein the hub component assembly comprises a first hub component to which the first set of rotor blades is coupled and a second hub component to which the second and third sets of rotor blades are coupled, wherein the first and second hub components are spaced apart.

17. The system of claim 16, wherein the hub component assembly further comprises a clutch arranged along a rotary shaft connecting the first and second hub components, wherein the clutch is configured to vary the times at which the first and second hub components are rotated relative to each other.

18. The system of claim 16, wherein the first and second hub components are coupled to distinct rotary shafts.

19. The fluid transfer controller of claim 12, further comprising a fluid outlet disposed on the second side of the hub component assembly substantially opposing the fluid inlet, wherein the fluid outlet is aligned and proximate to the intervening partition such that fluid routed through the second set of rotor blades is primarily routed through the fluid outlet.

20. A fluid transfer controller, comprising:

a rotor assembly comprising a hub component and multiple levels of rotor blades coupled by one or more intervening partitions, wherein the multiple levels of rotor blades and one or more intervening partitions are serially stacked upon the hub component;

barrier components configured to form passages for routing fluid among the multiple levels of rotor blades;

a fluid outlet substantially aligned and proximate to a first intervening partition coupled to a base level of rotor blades directly coupled to the hub component such that fluid is primarily received from the base level of rotor blades; and a fluid inlet which at least partially nests the fluid outlet and is arranged such that fluid is primarily routed to the level of rotor blades adjoining the base level of rotor blades via the first intervening partition.

21. The fluid transfer controller of claim 20, wherein at least one of the multiple sets of rotor blades is configured to change the state of the fluid.

22. The fluid transfer controller claim 20, wherein the barrier components are configured such that the one or more of the multiple levels of rotor blades and adjoining passages collectively form a spiraled fluid flow route about an annular reference spaced about a rotational axis of the hub component.

23. The fluid transfer controller of claim 20, further comprising channels coupled to the baffler components and configured for coupling to a thermal energy alteration device, wherein one of the channels is configured to route fluid from one level of the rotor blades to the thermal energy alteration device, and wherein another of the channels is configured to route fluid from the thermal energy alteration device to another level of the rotor blades.

24. The fluid transfer controller of claim 20, further comprising a thermal energy alteration device disposed within the barrier components and along the periphery of at least one level of the rotor blades.

25. The fluid transfer controller of claim 20, wherein an end of the fluid inlet is flared out away from the fluid outlet.

26. The fluid transfer controller of claim 20, wherein the fluid outlet comprises a gate.

27. A method for transporting fluid through a fluid transfer controller, comprising:

drawing fluid axially into a fluid inlet of the fluid transfer controller;

routing at least a partial amount of the drawn fluid through a gate disposed within the fluid inlet to bypass a first set of rotor blades of a rotor assembly of the fluid transfer controller;

moving the bypassed fluid radially through a second set of blades of the rotor assembly; and dispensing the fluid through an outlet of the fluid transfer controller subsequent to moving the bypassed fluid radially through the second set of blades.

28. The method of claim 27, further comprising moving the fluid radially through one or more additional sets of blades of the rotor assembly subsequent to the step of moving the fluid radially through the second set of blades and prior to the step of dispensing the fluid through the outlet of the fluid transfer controller.

29. The method of claim 27, further comprising routing a remainder amount of the drawn fluid to the first set of rotor blades and moving the fluid therethrough.

30. The method of claim 29, further comprising routing at least a partial amount of the fluid moved through the first set of rotor blades through a gate disposed within a barrier component forming a passage between the first and second sets of rotor blades to bypass the second set of rotor blades.

31. A fluid transfer controller, comprising:

a rotor assembly comprising a hub component and multiple levels of rotor blades coupled by one or more intervening partitions, wherein the multiple levels of rotor blades and one or more intervening partitions are serially stacked upon the hub component;

barrier components configured to form passages for routing fluid among different levels of rotor blades of the multiple levels of rotor blades; and a fluid intake duct substantially aligned and proximate to one of the intervening partitions such that incoming fluid is primarily routed through a first level of rotor blades directly coupled to the hub component, wherein the fluid intake duct comprises one or more gates to allow fluid to bypass the first set of rotor blades.

32. The fluid transfer controller of claim 31, wherein the fluid intake duct further comprises a blocking gate arranged proximate the inlet of the first set of rotor blades for blocking fluid flow through the first set of rotor blades.

33. The fluid transfer controller of claim 32, wherein the fluid transfer controller is configured to operate the blocking gate in conjunction with the one or more gates.

34. The fluid transfer controller of claim 31, further comprising a storage medium comprising program instructions executable by a processor for opening and closing the one or more gates depending on operational criteria set for the fluid transfer controller.

35. The fluid transfer controller of claim 31, wherein the baffler components are configured to form passages for successively routing fluid among neighboring levels of rotor blades of the multiple levels of rotor blades.

36. The fluid transfer controller of claim 31, wherein the baffler components comprise one or more gates to allow fluid to bypass at least one of the multiple levels of rotor blades.

37. The fluid transfer controller of claim 31, wherein at least one of the multiple levels of rotor blades is configured to change the state of the fluid.

38. The fluid transfer controller of claim 31, wherein the rotor assembly further comprises more than one level of rotor blades and one or more adjoining partitions successively stacked upon a side of the hub component opposing the multiple levels of rotor blades, and wherein the barrier components are configured to form other passages for routing fluid through the one or more levels of rotor blades.

39. The fluid transfer controller of claim 38, further comprising two distinct fluid intake ducts respectively configured to route incoming fluid through base levels of rotor blades directly coupled to opposing sides of the hub component.

40. A method for transporting fluid through a fluid transfer controller, comprising:

drawing fluid axially into a fluid inlet of the fluid transfer controller;

moving at least a partial amount of the drawn fluid radially through a first set of rotor blades of a rotor assembly of the fluid transfer controller;

routing at least a partial amount of the fluid moved through the first set of rotor blades through a gate disposed within a baffler component forming a passage winding alongside the rotor assembly and connecting the first set of rotor blades to a second set of rotor blades of the rotor assembly to bypass the second set of rotor blades; and dispensing the fluid through an outlet of the fluid transfer controller subsequent to routing the fluid through the gate.

41. The method of claim 40, further comprising routing a remainder amount of the fluid moved through the first set of rotor blades along the passage connecting the first set of rotor blades to the second set of rotor blades and moving the fluid therethrough.

42. The method of claim 40, further comprising moving the at least partial amount of fluid moved through the first set of rotor blades radially through one or more additional sets of blades of the rotor assembly prior to the step of routing the at least partial amount of fluid through the gate.

43. The method of claim 40, further comprising routing a remainder amount of the drawn fluid through a gate disposed within the fluid inlet to bypass the first set of rotor blades.

* * * * *

UNITED STATES PATENT AND TRADEMARK OFFICE

CERTIFICATE OF CORRECTION

PATENT NO. : 7,600,961 B2
APPLICATION NO. : 11/322100
DATED : October 13, 2009
INVENTOR(S) : Abdallah It is certified that error appears in the above-identified patent and that said Letters Patent is hereby corrected as shown below:

Claim 7 at col. 32, line 37: please delete "baffler" and substitute with --barrier--.

Claim 23 at col. 34, line 18: please delete "baffler" and substitute with --barrier--.

Claim 35 at col. 35, line 23: please delete "baffler" and substitute with --barrier--.

Claim 36 at col. 35, line 27: please delete "baffler" and substitute with --barrier--.

Claim 40 at col. 36, line 16: please delete "baffler" and substitute with --barrier--.

Signed and Sealed this

Ninth Day of March, 2010

David J. Kappos

David J. Kappos
*Director of the United States Patent and Trademark Office*